US007486909B2

(12) United States Patent
Sato et al.

(10) Patent No.: US 7,486,909 B2
(45) Date of Patent: Feb. 3, 2009

(54) IMAGE FORMING APPARATUS WITH A PLURALITY OF DRUM CARTRIDGES AND A PLURALITY OF DEVELOPER CARTRIDGES

(75) Inventors: Shougo Sato, Seto (JP); Makoto Ishii, Nagoya (JP); Yasushi Okabe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/902,038

(22) Filed: Sep. 18, 2007

(65) Prior Publication Data

US 2008/0019731 A1 Jan. 24, 2008

Related U.S. Application Data

(63) Continuation of application No. 10/782,973, filed on Feb. 23, 2004, now Pat. No. 7,395,008.

(30) Foreign Application Priority Data

Feb. 24, 2003 (JP) ..... 2003-046435
Mar. 13, 2003 (JP) ..... 2003-068200
Mar. 18, 2003 (JP) ..... 2003-074072

(51) Int. Cl.
*G03G 15/00* (2006.01)
*G03G 21/00* (2006.01)

(52) U.S. Cl. ..... 399/110; 399/124

(58) Field of Classification Search ..... 399/110, 399/111, 114, 121, 124, 299, 302, 303, 312, 399/308

See application file for complete search history.

(56) References Cited

U.S. PATENT DOCUMENTS 6,381,428 B1 4/2002 Yamamoto et al.
6,453,135 B1 * 9/2002 Sameshima et al. ..... 399/110
6,463,234 B2 10/2002 Arimitsu et al.
6,483,527 B2 11/2002 Kaneko et al.
6,501,925 B2 12/2002 Yamamoto et al.
6,608,981 B2 8/2003 Mae
6,681,088 B2 1/2004 Kanno et al.
6,697,586 B2 2/2004 Yamamoto et al.
6,708,011 B2 3/2004 Nomura et al.
6,799,011 B2 9/2004 Abe et al.

FOREIGN PATENT DOCUMENTS

CN 1311460 A 9/2001
CN 1369750 A 9/2002
JP A-7-281579 10/1995
JP A-7-295315 11/1995
JP A-8-15948 1/1996
JP A-8-137366 5/1996
JP A-8-137367 5/1996

(Continued)

*Primary Examiner*—Hoang Ngo
(74) *Attorney, Agent, or Firm*—Oliff & Berridge, PLC

(57) ABSTRACT

An image forming apparatus, includes: a mainframe; a photoreceptor; an exposing unit that exposes a surface of the photoreceptor to form an electrostatic latent image; and a developing unit that develops the electrostatic latent image by supplying a charged developer on the surface of the photoreceptor having the electrostatic latent image formed thereon. The photoreceptor is loadable in and unloadable from the mainframe separately from the developing unit.

12 Claims, 17 Drawing Sheets

FOREIGN PATENT DOCUMENTS

| | | |
|---|---|---|
| JP | A-10-48898 | 2/1998 |
| JP | A-10-48901 | 2/1998 |
| JP | A-10-149078 | 6/1998 |
| JP | A-10-186851 | 7/1998 |
| JP | A-10-307439 | 11/1998 |
| JP | A-2000-267380 | 9/2000 |
| JP | A-2000-321843 | 11/2000 |
| JP | A-2001-34021 | 2/2001 |
| JP | A-2001-134042 | 5/2001 |
| JP | A-2001-142378 | 5/2001 |
| JP | A-2001-166555 | 6/2001 |
| JP | A-2001-175122 | 6/2001 |
| JP | A-2001-255804 | 9/2001 |
| JP | A-2001-255806 | 9/2001 |
| JP | A-2001-281952 | 10/2001 |
| JP | A-2001-356548 | 12/2001 |
| JP | A-2002-72618 | 3/2002 |
| JP | A-2002-108049 | 4/2002 |
| JP | A-2002-304032 | 10/2002 |
| JP | A-2003-15378 | 1/2003 |

* cited by examiner

IMAGE FORMING APPARATUS WITH A PLURALITY OF DRUM CARTRIDGES AND A PLURALITY OF DEVELOPER CARTRIDGES

This is a Continuation of application Ser. No. 10/782,973 filed Feb. 23, 2004. This application claims the benefit of Japanese Patent Application Nos. 2003-46435, 2003-68200, and 2003-74072, filed Feb. 24, 2003, Mar. 13, 2003, and Mar. 18, 2003, respectively. The entire disclosures of the prior applications are hereby incorporated by reference herein in their entireties.

BACKGROUND OF THE INVENTION

1. Field of the Invention

The present invention relates to an apparatus for forming an image, such as a color laser printer.

2. Background Art

As an apparatus for forming a multicolor image, such as a four-color image, on a recording medium, such as recording paper, a tandem type apparatus has been known, which has, for each of colors, a photoreceptor, an exposing unit for exposing the photoreceptor to form an electrostatic latent image on the surface thereof, and a developing unit for developing the electrostatic latent image by attaching a charged developer on the surface of the photoreceptor having the electrostatic latent image formed thereon. A four-cycle type apparatus has also been known, which has one pair of an exposing unit and a photoreceptor, and plural developing unit for the respective colors arranged around the photoreceptor.

The four-cycle type apparatus is not suitable for speeding up the image formation because the exposing and developing steps of the photoreceptor are sequentially carried out with changing colors. In the tandem type apparatus, on the other hand, the exposing and developing steps of the photoreceptors can be simultaneously carried out for the colors, and a multicolor image can be formed by sequentially transferring the developers attached on the photoreceptors corresponding to the respective colors on a recording medium. Therefore, the tandem type apparatus for forming a multicolor image exhibits a color image forming speed equivalent to the case of a monochrome image, and is suitable for high-speed image formation.

SUMMARY OF THE INVENTION

In the apparatus for forming an image, the photoreceptor and the developing unit should be replaced as needed. In the tandem type apparatus for forming a multicolor image, plural pairs of a exposing unit and a photoreceptor are provided corresponding to the respective colors, and therefore, it is necessary to prevent the photoreceptor and the developing unit (which are, in some cases, integrally configured as an exchangeable process cartridge) from interfering with the exposing unit upon replacement. Under the circumstances, it has been proposed that the exposing unit is evacuated to prevent from interfering upon replacement of the process cartridge (as described, for example, in JP-A-2001-166555).

In the case where the exposing unit is evacuated upon replacement of the process cartridge, the relative positions of the exposing unit of the respective colors are slightly deviated to cause a possibility of color drift. However, it is difficult in the configuration of the conventional apparatus for forming a multicolor image that the process cartridge is replaced without evacuation of the exposing unit. In particular, it is significantly difficult that the photoreceptor is replaced without evacuation of the exposing unit because the photoreceptor is disposed in the back of the apparatus for forming a multicolor image as viewed from the user.

Further, the photoreceptor drums of the tandem type color laser printer are required to have an extremely high dimensional accuracy for preventing color drift because images of the respective colors are transferred from the four different photoreceptor drums onto the single transfer medium. Therefore, the processing of the photoreceptor drums brings about high cost.

As described, for example, in JP-A-10-48898, a tandem type color laser printer may have image forming units for each of colors, which integrally retains a toner cartridge, a photoreceptor drum and a developing roller, and the whole of the image forming unit is replaced in the case where the toner is emptied out.

However, in the case where the whole of the image forming unit is replaced, the expensive photoreceptor drum is also replaced when the toner is emptied out, so as to increase the running cost and to increase the amount of industrial waste.

According to an aspect of the invention, an image forming apparatus may include: a mainframe; a photoreceptor; an exposing unit that exposes a surface of the photoreceptor to form an electrostatic latent image; and a developing unit that develops the electrostatic latent image by supplying a charged developer on the surface of the photoreceptor having the electrostatic latent image formed thereon. The photoreceptor is loadable in and unloadable from the mainframe separately from the developing unit.

According to this aspect, the surface of the photoreceptor is exposed with the exposing unit to form an electrostatic latent image, and the latent image is developed by attaching the charged developer to the surface of the photoreceptor with the developing unit. The developers thus developing the electrostatic latent image on the surface of the photoreceptor provided is transferred to the recording medium to form an image on the recording medium. The apparatus of this aspect can be easily subjected to speeding up owing to the tandem type system.

The invention may provide a photoreceptor cartridge to be loaded in an image forming apparatus, wherein the image forming apparatus includes a developing unit that develops an electrostatic latent image by supplying a charged developer. The photoreceptor cartridge includes a photoreceptor having a surface on which the electrostatic latent image is formed to be developed by the developing unit. The photoreceptor cartridge is loadable in and unloadable from a mainframe of the image forming apparatus while being separated from the developing unit.

Preferably, the photoreceptor includes a plurality of photoreceptors for a plurality of colors, which are integrally retained. According to this configuration, the photoreceptor cartridge integrally retains the photoreceptors for each of colors, and is detachable from the mainframe as being separately from the developing unit. Due to this, the photoreceptors can be detached without interference with the exposing unit of the image forming apparatus as being separated from the developing unit. Therefore, the photoreceptor can be easily replaced without movement of the exposing unit, and thus, occurrence of color drift in the image forming apparatus can be fairly prevented.

BRIEF DESCRIPTION OF THE DRAWINGS

The present invention may be more readily described with reference to the accompanying drawings.

DETAILED DESCRIPTION OF THE PREFERRED EMBODIMENTS

The First Preferred Embodiment

Figure 1:
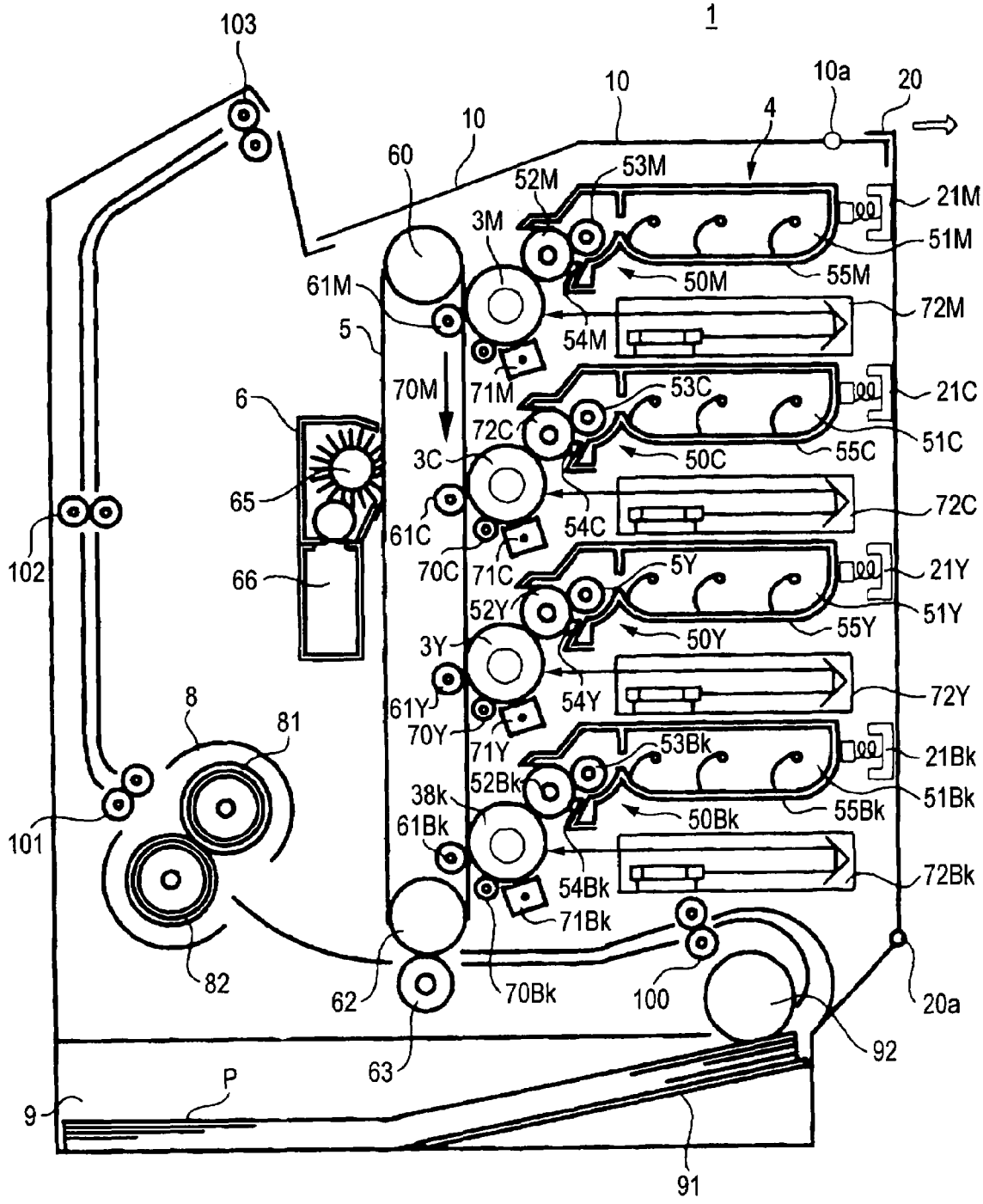
FIG. 1 is a schematic cross sectional view showing a laser color printer according to an embodiment of the invention.

Embodiments of the invention will be described with reference to the drawings. FIG. 1 is a schematic cross sectional view showing a color laser printer 1 as an apparatus for forming a multicolor image, to which the invention is applied. The color laser printer 1 shown in FIG. 1 has a visual image forming part 4, an intermediate transfer material in a belt form 5, a fixing part 8, a paper feeding part 9 and a paper delivery tray 10*b*.

The visual image forming part 4 has, for each of visual image forming steps with respective toners of magenta (M), cyan (C), yellow (Y) and black (Bk), developing devices 51M, 51C, 51Y and 51Bk as a developing unit, photoreceptor drums 3M, 3C, 3Y and 3Bk as a photoreceptor, cleaning rollers 70M, 70C, 70Y and 70Bk as a cleaning unit, charging devices 71M, 71C, 71Y and 71Bk as a charging unit, and exposing unit 72M, 72C, 72Y and 72Bk.

These configurational elements will be described in more detail below. The developing devices 51M, 51C, 51Y and 51Bk have developing rollers 52M, 52C, 52Y and 52Bk, respectively. The developing rollers 52M, 52C, 52Y and 52Bk each is configured in the form of a cylinder with electroconductive silicone rubber as a base material having formed on the surface thereof a coated layer of a resin or rubber material containing fluorine. The developing rollers 52M, 52C, 52Y and 52Bk may not be configured with electroconductive silicone rubber but may be configured with electroconductive urethane rubber. The ten-point average roughness (Rz) of the surface thereof is from 3 to 5 μm, which is smaller than 9 μm, the average particle diameter of the toner.

The developing devices 51M, 51C, 51Y and 51Bk have feeding rollers 53M, 53C, 53Y and 53Bk, respectively. The feeding rollers 53M, 53C, 53Y and 53Bk are electroconductive sponge rollers, which are in contact with the developing rollers 52M, 52C, 52Y and 52Bk, respectively, under pressure with an elastic force of sponge. The feeding rollers 53M, 53C, 53Y and 53Bk may be configured with a foamed body of a suitable material, such as electroconductive silicone rubber, EPDM and urethane rubber.

The developing devices 51M, 51C, 51Y and 51Bk have squeezing blades 54M, 54C, 54Y and 54Bk, respectively. The squeezing blades 54M, 54C, 54Y and 54Bk are formed in a plate form having a stainless steel base end fixed to casings 55M, 55C, 55Y and 55Bk of the developing devices, and a tip end edge formed with insulating silicone rubber, insulating fluorine rubber or resin, or the like. The tip end edges of the squeezing blades 54M, 54C, 54Y and 54Bk are in contact with the developing rollers 52M, 52C, 52Y and 52Bk, respectively, under pressure from underneath of the developing rollers 52M, 52C, 52Y and 52Bk.

The toner housed in the casings 55M, 55C, 55Y and 55Bk of the developing devices is a positively charged non-magnetic one-component developer, which has toner mother particles having an average particle diameter of 9 μm formed by adding a known coloring agent, such as carbon black, and a charge controlling agent, such as a quaternary ammonium salt, or a charge controlling resin to a styrene-acrylic resin formed into a spherical form by suspension polymerization. The toner contains silica as an external additive on the surface of the toner mother particles. The silica as the external additive has been subjected to a known hydrophobic treatment with a silane coupling agent, a silicone oil or the like, and has an average particle diameter of 10 nm. The addition amount of the silica is 0.6% by weight based on the amount of the toner mother particles. Magenta, cyan, yellow and black toners are housed in the casings 55M, 55C, 55Y and 55Bk of the developing devices, respectively.

The toner is excellent in flowability because the toner is a suspension polymerization toner having such a shape that is extremely close to sphere, and contains hydrophobic silica having an average particle diameter of 10 nm in an amount of 0.6% by weight. Therefore, a sufficient charge amount can be obtained through frictional charge. Furthermore, the toner does not have sharp corners, which are found in pulverized toners. Therefore, the toner is difficult to receive mechanical forces, is excellent in followability to an electric field, and exhibits good transfer efficiency.

The photoreceptor drums 3M, 3C, 3Y and 3Bk each is formed, for example, with an aluminum base material having formed thereon a positively charging photosensitive layer. The thickness of the photosensitive layer is 20 μm or more, and the aluminum base material is used as a grounding layer. In this embodiment, a slight difference is provided between the velocities of the photoreceptor drums 3M, 3C, 3Y and 3Bk and an intermediate transfer material 5.

The cleaning rollers 70M, 70C, 70Y and 70Bk each is a roller formed with an elastic material, such as electroconductive sponge, and are in frictionally contact with the photoreceptor drums 3M, 3C, 3Y and 3Bk, respectively, from underneath of the photoreceptor drums 3M, 3C, 3Y and 3Bk. The cleaning rollers 70M, 70C, 70Y and 70Bk are applied with a negative voltage, which is contrary to the toners, with an electric power source not shown in the figure, and remove the remaining toners on the photoreceptor drums 3M, 3C, 3Y and 3Bk through actions of the frictional force to the photoreceptor drums 3M, 3C, 3Y and 3Bk and an electric field formed by the applied voltage. This embodiment employs a so-called cleaner-less developing system, in which the remaining toners thus removed with the cleaning rollers 70M, 70C, 70Y and 70Bk in the prescribed process step after completing the developing step are returned to the photoreceptor drums 3M, 3C, 3Y and 3Bk, and then recovered by the developing rollers 52M, 52C, 52Y and 52Bk into the developing devices 51M, 51C, 51Y and 51Bk of the corresponding colors.

The charging devices 71M, 71C, 71Y and 71Bk are scorotron charging devices and are disposed to face the photoreceptor drums 3M, 3C, 3Y and 3Bk in non-contact therewith from underneath of the photoreceptor drums 3M, 3C, 3Y and 3Bk on the downstream of the rotation direction of the photoreceptor drums 3M, 3C, 3Y and 3Bk with respect to the cleaning rollers 70M, 70C, 70Y and 70Bk.

The exposing unit 72M, 72C, 72Y and 72Bk each is configured with a known laser scanner unit. The exposing unit 72M, 72C, 72Y and 72Bk are disposed to overlap in the vertical direction the developing devices 51M, 51C, 51Y and 51Bk of the visual image forming part 4, and to overlap in the horizontal direction the photoreceptor drums 3M, 3C, 3Y and 3Bk and the charging devices 71M, 71C, 71Y and 71Bk, and expose the surfaces of the photoreceptor drums 3M, 3C, 3Y and 3Bk with laser light on the downstream of the rotation direction of the photoreceptor drums 3M, 3C, 3Y and 3Bk with respect to the charging devices 71M, 71C, 71Y and 71Bk. The surfaces of the photoreceptor drums 3M, 3C, 3Y and 3Bk are exposed with laser light corresponding to image data by the exposing unit 72M, 72C, 72Y and 72Bk to form electrostatic latent images of each of colors on the surfaces of the photoreceptor drums 3M, 3C, 3Y and 3Bk.

The toners are positively charged, and then the toners are fed to the developing rollers 52M, 52C, 52Y and 52Bk through the feeding rollers 53M, 53C, 53Y and 53Bk and formed into thin layers with the squeezing blades 54M, 54C, 54Y and 54Bk. The toners thus positively charged develop negatively the electrostatic latent images thus positively charged on the photoreceptor drums 3M, 3C, 3Y and 3Bk in good conditions to form images with significantly high quality.

The intermediate transfer material 5 in a belt form (corresponding to the transfer medium) is formed with an electroconductive sheet, such as polycarbonate and polyimide, into a belt form. The intermediate transfer material 5 in a belt form is hung on two driving rollers 60 and 62, and intermediate transfer rollers 61M, 61C, 61Y and 61Bk are disposed in the vicinities of the positions facing the photoreceptor drums 3M, 3C, 3Y and 3Bk. The surface of the intermediate transfer material 5 facing the photoreceptor drums 3M, 3C, 3Y and 3Bk is conveyed from top down in the vertical direction, as shown in FIG. 1.

The intermediate transfer rollers 61M, 61C, 61Y and 61Bk are applied with a prescribed voltage to transfer the toner images formed on the photoreceptor drums 3M, 3C, 3Y and 3Bk onto the intermediate transfer material 5. A secondary transfer roller 63 is provided to face the roller 62 provided down below in the vertical direction of the intermediate transfer material 5, at which the toner images are transferred to paper P (corresponding to the recording medium), and the secondary transfer roller 63 is also applied with a prescribed voltage. As a result, the toner images of four colors carried on the intermediate transfer material 5 in a belt form are transferred to the paper P.

A cleaning device 6 is provided on the side of the intermediate transfer material 5 opposite to the photoreceptor drums 3M, 3C, 3Y and 3Bk, as shown in FIG. 1. The cleaning device is configured with a scraping member 65 and a casing 66, and the toner remaining on the intermediate transfer material 5 is scraped with the scraping member 65 to house in the casing 66.

The fixing part 8 is configured with a first heating roller 81 and a second heating roller 82, and the paper P carrying the toner images of four colors is conveyed by holding between the first heating roller 81 and the second heating roller 82 under heat and pressure to fix the toner images on the paper P.

The paper feeding part 9 is provided at the bottom of the apparatus and is configured with a housing tray 91 housing paper P and a pickup roller 92 for delivering the paper P. The paper feeding part 9 feeds the paper P at a prescribed timing corresponding to the image forming step carried out by the exposing unit 72M, 72C, 72Y and 72Bk, the developing devices 51M, 51C, 51Y and 51Bk, the photoreceptor drums 3M, 3C, 3Y and 3Bk, and the intermediate transfer material 5.

An upper cover 10 is provided rotatably around an axis 10*a* on the top of the apparatus, and a part of the surface cover 10 configures a paper delivery tray 10*b*. The paper delivery tray 10*b* is provided on the paper delivery side of the fixing part 8 and houses the paper P thus delivered from the fixing part 8 and conveyed by pairs of rollers 101, 102 and 103.

In this embodiment as shown in FIG. 1, a front cover 20 is provided rotatably in the direction shown in FIG. 1 around an axis 20*a*. The developing devices 51M, 51C, 51Y and 51Bk can be replaced by opening the front cover 20. Spring members 21M, 21C, 21Y and 21Bk are provided on the front cover 20 at the positions facing the developing devices 51M, 51C, 51Y and 51Bk to press the developing devices 51M, 51C, 51Y and 51Bk to the rear (leftward in FIG. 1) upon closing the front cover 20.

Figure 2B:
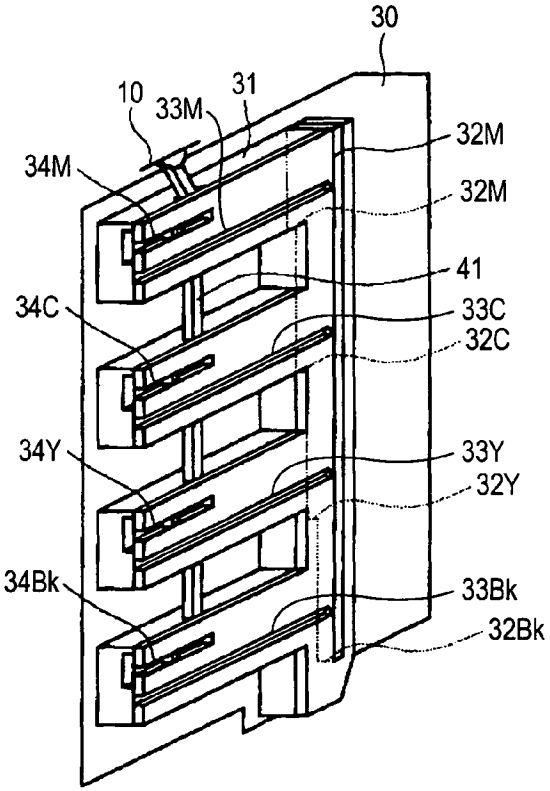
FIGS. 2A and 2B are a side view and a perspective view, respectively, showing a configuration of a supporting member of the printer.
Figure 2A:
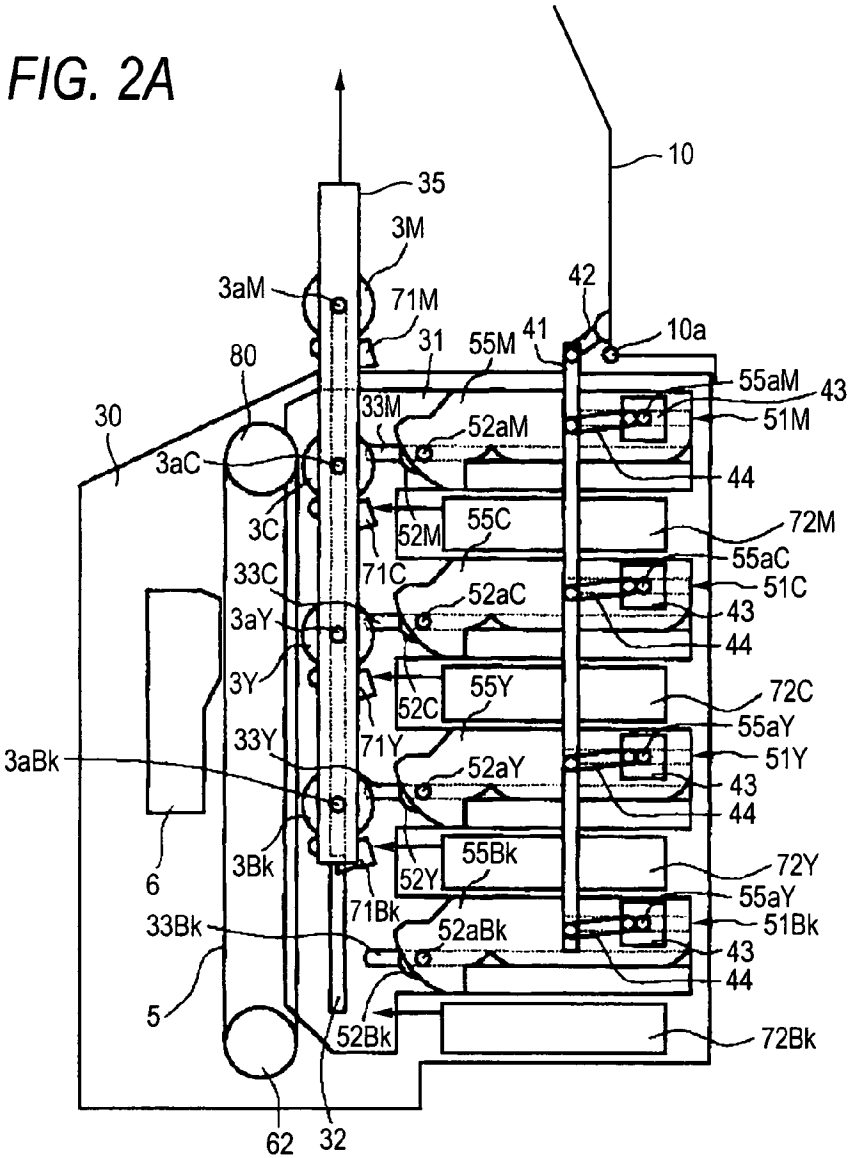

As shown in FIG. 2A, a side view, and FIG. 2B, a perspective view, supporting members 31 for supporting the photoreceptor drums 3M, 3C, 3Y and 3Bk and the developing devices 51M, 51C, 51Y and 51Bk are fixed on side panels 30 on the right and left sides of the color laser printer 1. The supporting member 31 has formed therein a substantially vertical guide channel 32 for guiding axes 3*a*M, 3*a*C, 3*a*Y and 3*a*Bk of the photoreceptor drums 3M, 3C, 3Y and 3Bk, substantially horizontal guide channels 33M, 33C, 33Y and 33Bk for guiding axes 52*a*M, 52*a*C, 52*a*Y and 52*a*Bk of the developing rollers 52M, 52C, 52Y and 52Bk, and substantially horizontal guide channels 34M, 34C, 34Y and 34Bk for guiding projections 55*a*M, 55*a*C, 55*a*Y and 55*a*Bk provided on the casings 55M, 55C, 55Y and 55Bk of the developing devices.

The axes 52*a*M, 52*a*C, 52*a*Y and 52*a*Bk of the developing rollers 52M, 52C, 52Y and 52Bk are positioned at tip ends of the guide channels 33M, 33C, 33Y and 33Bk, respectively, by pressing the casings 55M, 55C, 55Y and 55Bk of the developing devices with the spring members 21M, 21C, 21Y and 21Bk upon closing the front cover 20.

Figure 3:
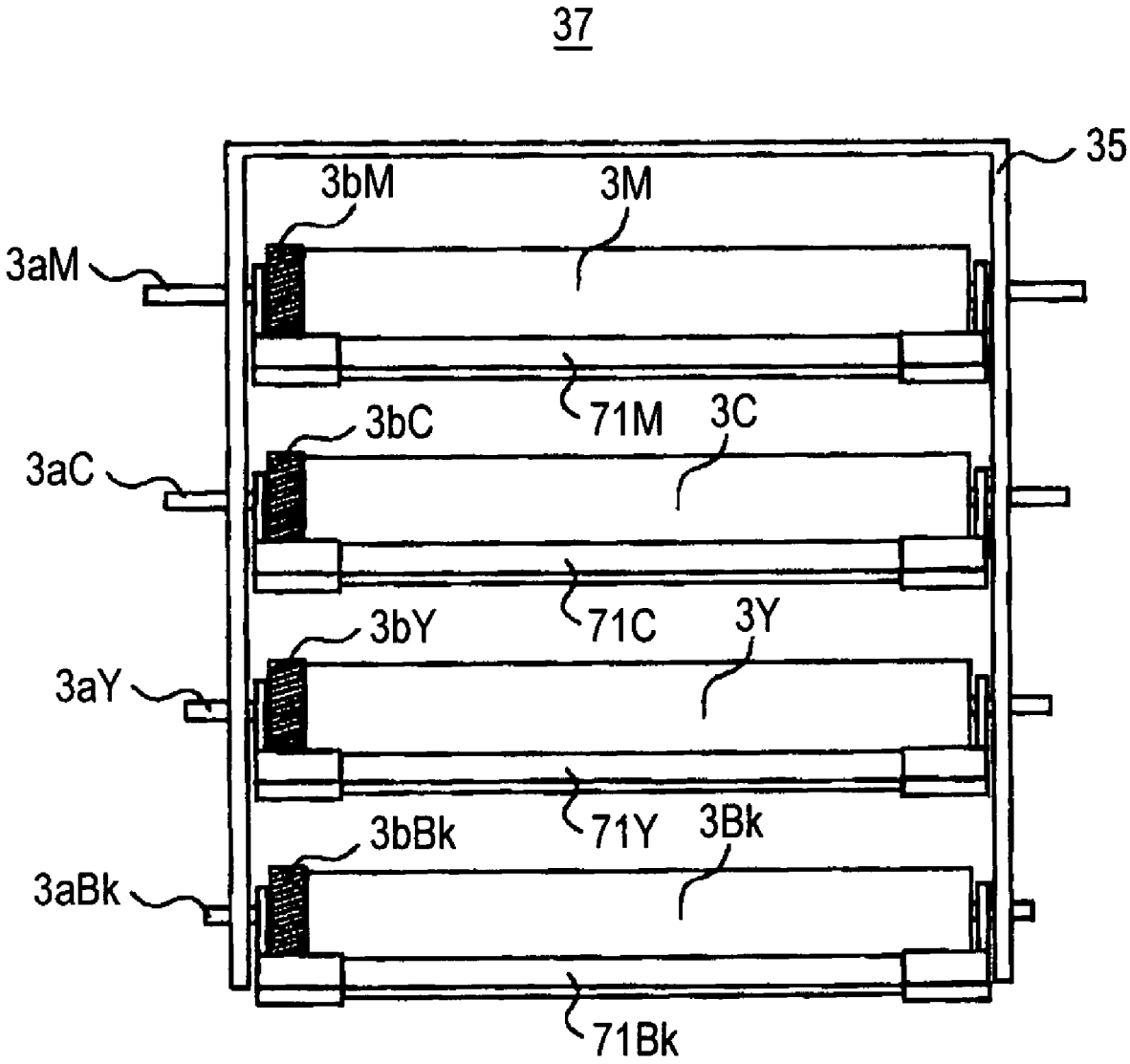
FIG. 3 is an elevational view showing a configuration of a photoreceptor cartridge of the printer.

The photoreceptor drums 3M, 3C, 3Y and 3Bk are retained by a holder 35 and are integrally detachable upon opening the upper cover 10. As shown in FIG. 3, the holder 35 is formed to have a substantially horseshoe shape with an opening downward and retains the photoreceptor drums 3M, 3C, 3Y and 3Bk being in parallel to each other to configure a photoreceptor cartridge 37. The holder 35 also retains the charging devices 71M, 71C, 71Y and 71Bk. The holder 35 further retains the cleaning rollers 70M, 70C, 70Y and 70Bk, which are not shown in the figure.

As shown in FIG. 3, gears 3*b*M, 3*b*C, 3*b*Y and 3*b*Bk provided on the outer peripheries of the photoreceptor drums 3M, 3C, 3Y and 3Bk are exposed from the holder 35 and are engaged with gears of a driving system, which is not shown in the figure, upon mounting the photoreceptor cartridge 37 on the color laser printer 1 to enable driving of the photoreceptor drums 3M, 3C, 3Y and 3Bk. The lengths of the axes 3*a*M, 3*a*C, 3*a*Y and 3*a*Bk of the photoreceptor drums 3M, 3C, 3Y and 3Bk are sequentially decreased in this order (i.e., the lower axis is shorter). That is, the protruding lengths of the axes 3*a*M, 3*a*C, 3*a*Y and 3*a*Bk from the holder 35 are increased from the upstream to the downstream in the mounting direction of the photoreceptor cartridge 37 on the color laser printer 1. Corresponding to the configuration, step parts 32M, 32C, 32Y and 32Bk are formed in the guide channel 32, as shown in FIG. 2B, and the axes 3*a*M, 3*a*C, 3*a*Y and 3*a*Bk are engaged with the step parts 32M, 32C, 32Y and 32Bk, respectively, to position the photoreceptor drums 3M, 3C, 3Y and 3Bk.

A linking rod 41 is vertically provided on the supporting member 31, and the linking rod 41 moves vertically associated with closing and opening motion of the upper cover 10, whereby the developing devices 51M, 51C, 51Y and 51Bk move upon opening the upper cover 10 as described below.

Figure 4A:
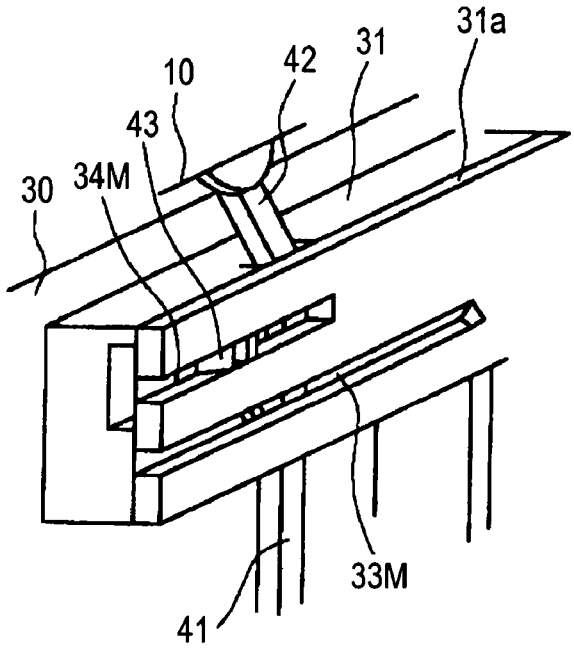
FIGS. 4A and 4B are perspective views showing a detailed configuration of the supporting member.
Figure 4B:
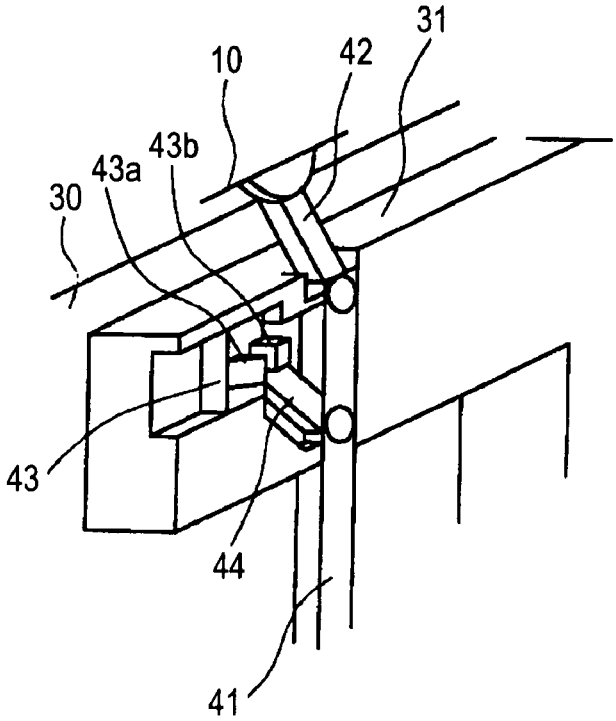

FIG. 4A is a perspective view showing the configuration of the vicinity of the part of the supporting member 31 where the guide channels 33M and 34M, and FIG. 4B is a perspective view showing the configuration in the state where an inner panel 31*a*(the guide channels 33M and 34M are formed in the inner panel 31*a*) is removed from the supporting member 31. The vicinity of the guide channels 33C and 34C, the vicinity of the guide channels 33Y and 34Y, and the vicinity of the guide channels 33Bk and 34Bk are configured in the similar manner.

As shown in FIG. 4B, an upper end of the linking rod 41 is swingably connected to one end of a linking rod 42, the other end of which is swingably connected to the upper cover 10. According to the configuration, the movement of the upper cover 10 is transferred to the linking rod 41 through the linking rod 42, and the linking rod 41 moves vertically upon opening and closing the upper cover 10. The guide channel 34M has on the outside thereof (on the side of the side panel 30) a slider 43 capable of slidingly moving along the guide channel 34M, and one end of a linking rod 44 is swingably connected to the slider 43. The other end of the linking rod 44 is swingably connected to the linking rod 41. The slider 43 is disposed in front of the linking rod 41 (on the near side in FIGS. 4A and 4B), and the connecting part of the linking rod 44 and the slider 43 is disposed above the connecting part of the linking rod 44 and the linking rod 41. According to the configuration, upon opening the upper cover 10, the linking rod 44 falls down to the substantially horizontal position associated with a scent of the linking rod 41, whereby the slider 43 moves forward. Upon closing the upper cover 10, on the other hand, the slider 43 moves backward associated with descent of the linking rod 41.

The slider 43 has on the inner surface thereof a pair of projections 43*a*and 43*b*provided with a certain distance in the back and forth direction. According to the configuration, in the case where the projections 55*a*M, 55*a*C, 55*a*Y and 55*a*Bk are disposed between the corresponding projections 43*a* and 43*b*, the projections 43*b* push the projections 55*a*M, 55*a*C, 55*a*Y and 55*a*Bk forward against the biasing force of the spring members 21M, 21C, 21Y and 21Bk upon opening the upper cover 10, so as to move the developing devices 51M, 51C, 51Y and 51Bk forward (rightward in FIG. 1). Upon closing the upper cover 10, the projections 43*a* push the projections 55*a*M, 55*a*C, 55*a*Y and 55*a*Bk backward, so as to move the developing devices 51M, 51C, 51Y and 51Bk backward.

The back end of the moving range of the slider 43 is the position where the developing rollers 52M, 52C, 52Y and 52Bk are in substantially contact with the photoreceptor drums 3M, 3C, 3Y and 3Bk, respectively, and precise positioning can be attained by receiving the pressing force from the spring members 21M, 21C, 21Y and 21Bk as described in the foregoing. The front end of the moving range of the slider 43 is the position where the developing devices 51M, 51C, 51Y and 51Bk are certainly evacuated from the moving path for detaching the photoreceptor cartridge 37, and the developing devices 51M, 51C, 51Y and 51Bk can be easily replaced. The projections 55*a*M, 55*a*C, 55*a*Y and 55*a*Bk are temporarily retracted into the casings 55M, 55C, 55Y and 55Bk of the developing devices by operating a prescribed lever (or button), which is not shown in the figure, provided on the casings 55M, 55C, 55Y and 55Bk of the developing devices. According to the configuration, engagement of the projections 55*a*M, 55*a*C, 55*a*Y and 55*a*Bk and the projections 43*a* and 43*b* is released to enable replacement of the developing devices 51M, 51C, 51Y and 51Bk.

The front surface of the projection 43*a* on the near side forms a tapered surface, and the projections 55*a*M, 55*a*C, 55*a*Y and 55*a*Bk pressed from the front over stride the projection 43*a* by being retracted as described in the foregoing. According to the configuration, the developing devices 51M, 51C, 51Y and 51Bk can be mounted without operation of the lever or button. Furthermore, the pressing force necessary for the projections 55*a*M, 55*a*C, 55*a*Y and 55*a*Bk to overstride the projection 43*a* is smaller than the pressing force applied by the spring members 21M, 21C, 21Y and 21Bk. Therefore, the developing devices 51M, 51C, 51Y and 51Bk can be completely mounted by lightly inserting the developing devices 51M, 51C, 51Y and 51Bk, followed by closing the front cover 20.

The operation of the color laser printer 1 according to the embodiment will be described. The photosensitive layers of the photoreceptor drums 3M, 3C, 3Y and 3Bk are uniformly charged with the charging devices 71M, 71C, 71Y and 71Bk, respectively, and then the photosensitive layers are exposed corresponding to images of magenta color, cyan color, yellow color and black color, respectively. A magenta toner, a cyan toner, a yellow toner and a black toner are attached to electrostatic latent images formed on the photosensitive layers of the photoreceptor drums 3M, 3C, 3Y and 3Bk with the magenta developing device 51M, the cyan developing device 51C, the yellow developing device 51Y and the black developing device 51Bk, so as to effect development of magenta color, cyan color, yellow color and black color. The toner images of magenta color, cyan color, yellow color and black color thus formed are once transferred onto the intermediate transfer material 5.

The toners remaining on the photoreceptor drums 3M, 3C, 3Y and 3Bk after transferring are temporarily retained by the cleaning rollers 70M, 70C, 70Y and 70Bk. The toner images of the respective colors are formed with certain time differences among them corresponding to the moving velocity of the intermediate transfer material 5 and the positions of the photoreceptor drums 3M, 3C, 3Y and 3Bk, and the toner images of the colors are transferred to overlap on the intermediate transfer material 5.

The toner images of the four colors thus formed on the intermediate transfer material 5 are transferred onto the paper P fed from the paper feeding part 9 at the position where the secondary transfer roller 63 and the intermediate transfer material 5 are in contact with each other under pressure. The toner images are fixed on the paper P in the fixing part 8 and delivered to the paper delivery tray 10*b*. Thus, a four-color image is formed.

In the case where the photoreceptor drums 3M, 3C, 3Y and 3Bk are replaced, the upper cover 10 is opened, whereby the developing devices 51M, 51C, 51Y and 51Bk are evacuated from the moving path of the photoreceptor cartridge 37, and the photoreceptor drums 3M, 3C, 3Y and 3Bk can be taken out by with drawing the photoreceptor cartridge 37 upward. In the case where a new one of a photoreceptor cartridge 37 is mounted, the upper cover 10 is left opening, and the photoreceptor cartridge 37 is brought down with the axes 3*a*M, 3*a*C, 3*a*Y and 3*a*Bk of the photoreceptor drums 3M, 3C, 3Y and 3Bk being engaged with the guide channel 32. The axes 3*a*M, 3*a*C, 3*a*Y and 3*a*Bk are then positioned at the step parts 32M, 32C, 32Y and 32Bk.

Figure 5:
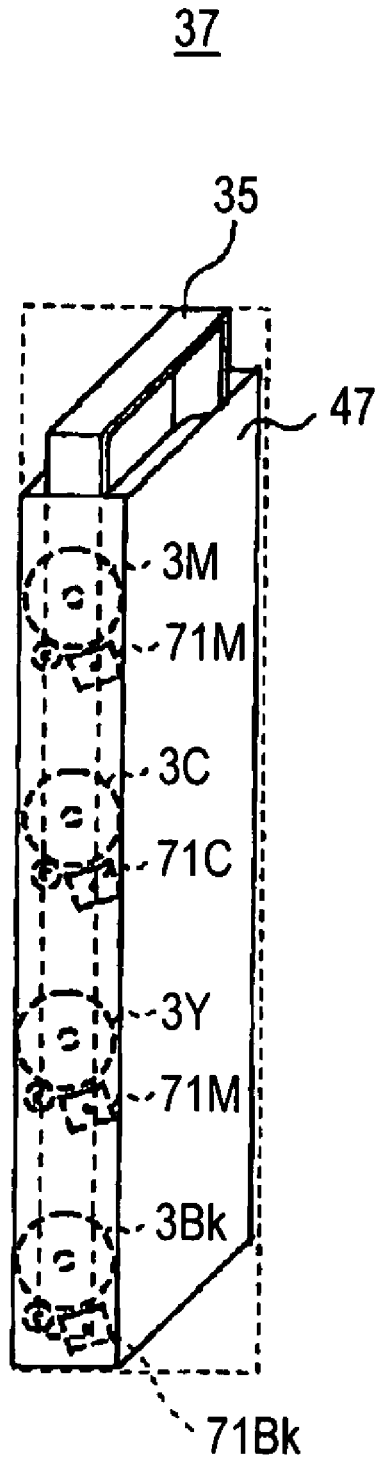
FIG. 5 is an elevational view showing the photoreceptor cartridge before mounting.

The new photoreceptor cartridge 37 is covered with a covering member 47 as shown in FIG. 5, and upon mounting the photoreceptor cartridge 37, the covering member 47 is removed. Accordingly, the photoreceptor drums 3M, 3C, 3Y and 3Bk are favorably prevented from being damaged until the photoreceptor cartridge 37 is mounted on the color laser printer 1. Upon opening the upper cover 10, the developing devices 51M, 51C, 51Y and 51Bk move to the front side, at which they can be easily taken out, and on this occasion, the developing devices 51M, 51C, 51Y and 51Bk can be replaced by opening the front cover 20. Thus, the maintenance property is improved.

In this embodiment having been described herein, the photoreceptor drums 3M, 3C, 3Y and 3Bk are integrally retained in the photoreceptor cartridge 37 and are detachable separately from the developing devices 51M, 51C, 51Y and 51Bk. Furthermore, the detaching direction thereof is the substantially vertical direction, which is substantially in parallel to the conveying direction of the intermediate transfer material 5 on the surface facing the photoreceptor drums 3M, 3C, 3Y and 3Bk and to the aligning direction of the photoreceptor drums 3M, 3C, 3Y and 3Bk. According to the configuration, the photoreceptor drums 3M, 3C, 3Y and 3Bk can be replaced without interference with the exposing unit 72M, 72C, 72Y and 72Bk to prevent favorably color drift from occurring.

Upon mounting the photoreceptor cartridge 37, the axes 3*a*M, 3*a*C, 3*a*Y and 3*a*Bk are positioned at the step parts 32M, 32C, 32Y and 32Bk, whereby the photoreceptor drums 3M, 3C, 3Y and 3Bk can be precisely positioned to prevent further favorably color drift from occurring. Upon opening the upper cover 10 for detaching the photoreceptor cartridge 37, the developing devices 51M, 51C, 51Y and 51Bk are automatically evacuated from the moving path of the photoreceptor cartridge 37, whereby the photoreceptor cartridge 37 can be easily detached.

In this embodiment, moreover, the charging devices 71M, 71C, 71Y and 71Bk are integrally retained in the photoreceptor cartridge 37 and can be replaced simultaneously with the photoreceptor drums 3M, 3C, 3Y and 3Bk, whereby the maintenance property of the color laser printer 1 is improved. The service life of the charging devices 71M, 71C, 71Y and 71Bk is longer than that of the developing devices 51M, 51C, 51Y and 51Bk and is equivalent to or longer than that of the photoreceptor drums 3M, 3C, 3Y and 3Bk. In this embodiment, therefore, the running cost of the color laser printer 1 can be further reduced in comparison to the case where the charging devices 71M, 71C, 71Y and 71Bk are replaced simultaneously with the developing devices 51M, 51C, 51Y and 51Bk.

Figure 6:
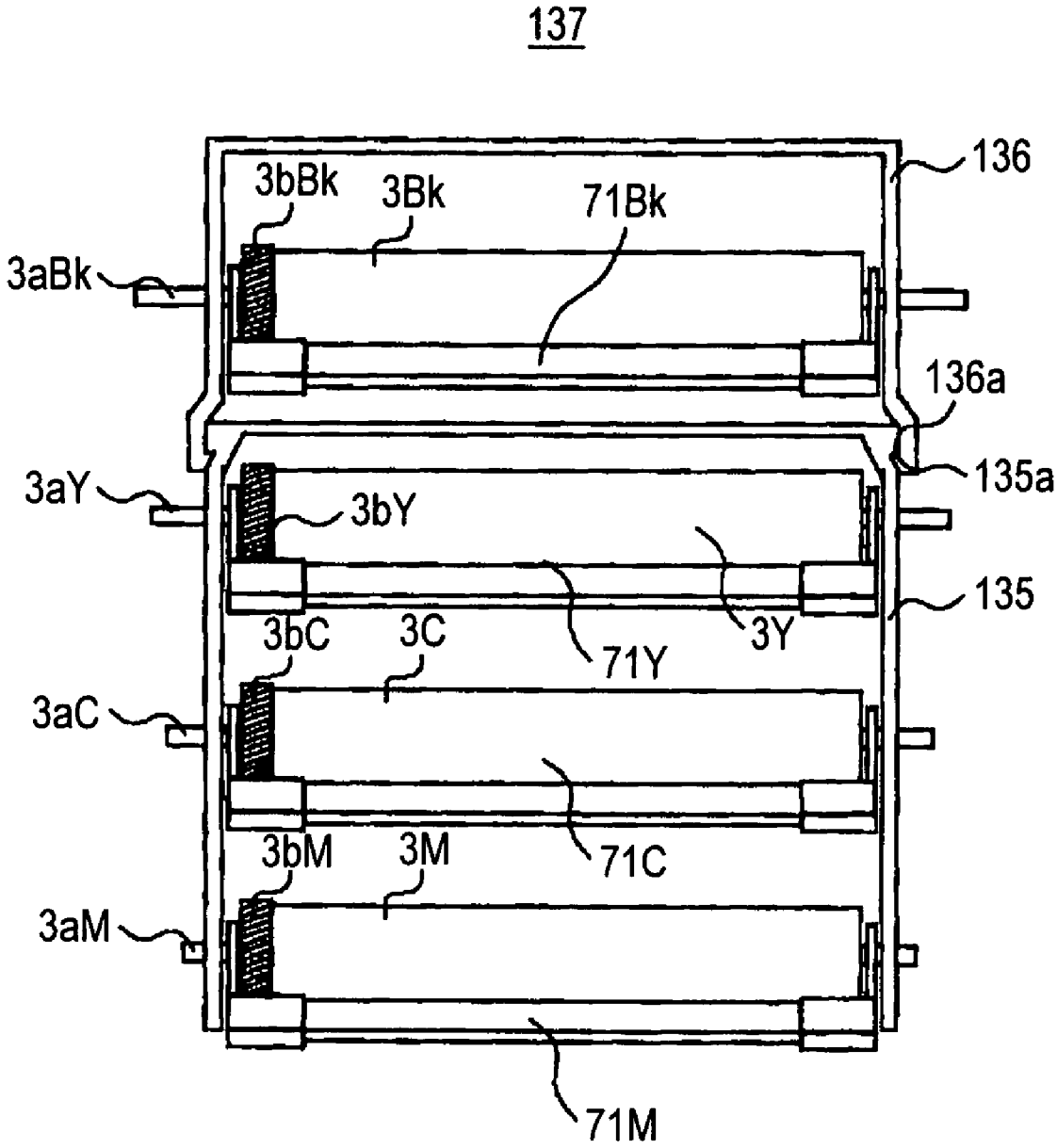
FIG. 6 is an elevational view showing a modified embodiment of the photoreceptor cartridge.

In the case where the configuration of this embodiment is changed to dispose assemblies black (Bk), yellow (Y), cyan (C) and magenta (M) in this order from top down, it is possible that the photoreceptor cartridge is configured in the manner shown in FIG. 6, whereby the running cost can be further reduced. Specifically, in the photoreceptor cartridge 137 shown in FIG. 6, photoreceptor drums 3M, 3C and 3Y, cleaning rollers 70M, 70C and 70Y, and charging devices 71M, 71C and 71Y are retained by a holder 135 having a substantially horseshoe shape with an opening downward, and a photoreceptor drum 3Bk, a cleaning roller 70Bk and a charging device 71Bk are retained by a holder 136 having a substantially horseshoe shape with an opening downward and being capable of connecting to an upper part of the holder 135. A hook 136*a* is provided at the lower end of the holder 136 and is capable of being engaged with a female hook 135*a* provided at the upper end of the holder 135. The hook 136*a* temporarily moves outward by operating a lever (or button), which is not shown in the figure, provided in an upper part of the holder 136, so as to release the engagement with the female hook 135*a*.

In the case where the photoreceptor cartridge 137 thus configured is withdrawn upward without releasing the engagement, the photoreceptor drums 3M, 3C, 3Y and 3Bk, the cleaning rollers 70M, 70C, 70Y and 70Bk, and the charging devices 71M, 71C, 71Y and 71Bk can be integrally replaced as similar to the case of the photoreceptor cartridge 37. In the case where the engagement is released, on the other hand, only the photoreceptor drum 3Bk, the cleaning roller 70Bk and the charging device 71Bk can be replaced with the photoreceptor drums 3M, 3C and 3Y, the cleaning roller 70M, 70C and 70Y, and the charging devices 71M, 71C and 71Y being left remaining in the color laser printer 1.

Black color is frequently used in comparison to the other colors, and therefore, the service life of the photoreceptor 3Bk expires faster in comparison to the photoreceptor drums 3M, 3C and 3Y. In the photoreceptor cartridge 137, only the photoreceptor drum 3Bk can be replaced with the photoreceptor drums 3M, 3C and 3Y being left remaining, whereby the running cost of the color laser printer 1 can be further reduced. The photoreceptor cartridge 137 is also covered with a covering member similar to the covering member 47.

In the embodiments described in the foregoing, the photoreceptor cartridge 137 is detached in the direction, which is substantially perpendicular to the axes 3*a*M, 3*a*C, 3*a*Y and 3*a*Bk, whereby the configuration of the bearing part and the like can be simplified to reduce the production cost of the color laser printer 1, in comparison to the case where the photoreceptor cartridge is detached along the axes 3*a*M, 3*a*C, 3*a*Y and 3*a*Bk. In the embodiments, furthermore, the photoreceptor 3M, 3C, 3Y and 3Bk can be replaced as being separated from the developing devices 51M, 51C, 51Y and 51Bk, whereby the running cost of the color laser printer 1 can be further reduced in comparison to the case where they are integrally replaced.

In the embodiments described in the foregoing, the guide channel 32 corresponds to the guide part, the axes 3*a*M, 3*a*C, 3*a*Y and 3*a*Bk correspond to the guided part, and the linking rods 41, 42 and 43 and the slider 43 correspond to the evacuating unit. The invention is not limited to the embodiments and can be practiced with various embodiments as far as the gist of the invention is not deviated. For example, it is not necessary that the developing devices 51M, 51C, 51Y and 51Bk are automatically evacuated.

Furthermore, it is possible that the spring members 21M, 21C, 21Y and 21Bk are omitted, and the front cover 20 is provided apart from the developing devices 51M, 51C, 51Y and 51Bk. In this case, however, it is preferred that the developing rollers 52M, 52C, 52Y and 52Bk are positioned, for example, by such a manner that spring members for fixing the axes 52*a*M, 52*a*C, 52*a*Y and 52*a*Bk are provided at tip ends of the guide channels 33M, 33C, 33Y and 33Bk.

Moreover, while the toners are once transferred to the intermediate transfer material 5 and then further transferred to the paper P in the embodiment, the toners may be directly transferred to the paper P. In this case, the paper P corresponds to both the recording medium and the transfer medium. Still moreover, the guide part may be a rail instead of a channel.

The Second Preferred Embodiment

Figure 7:
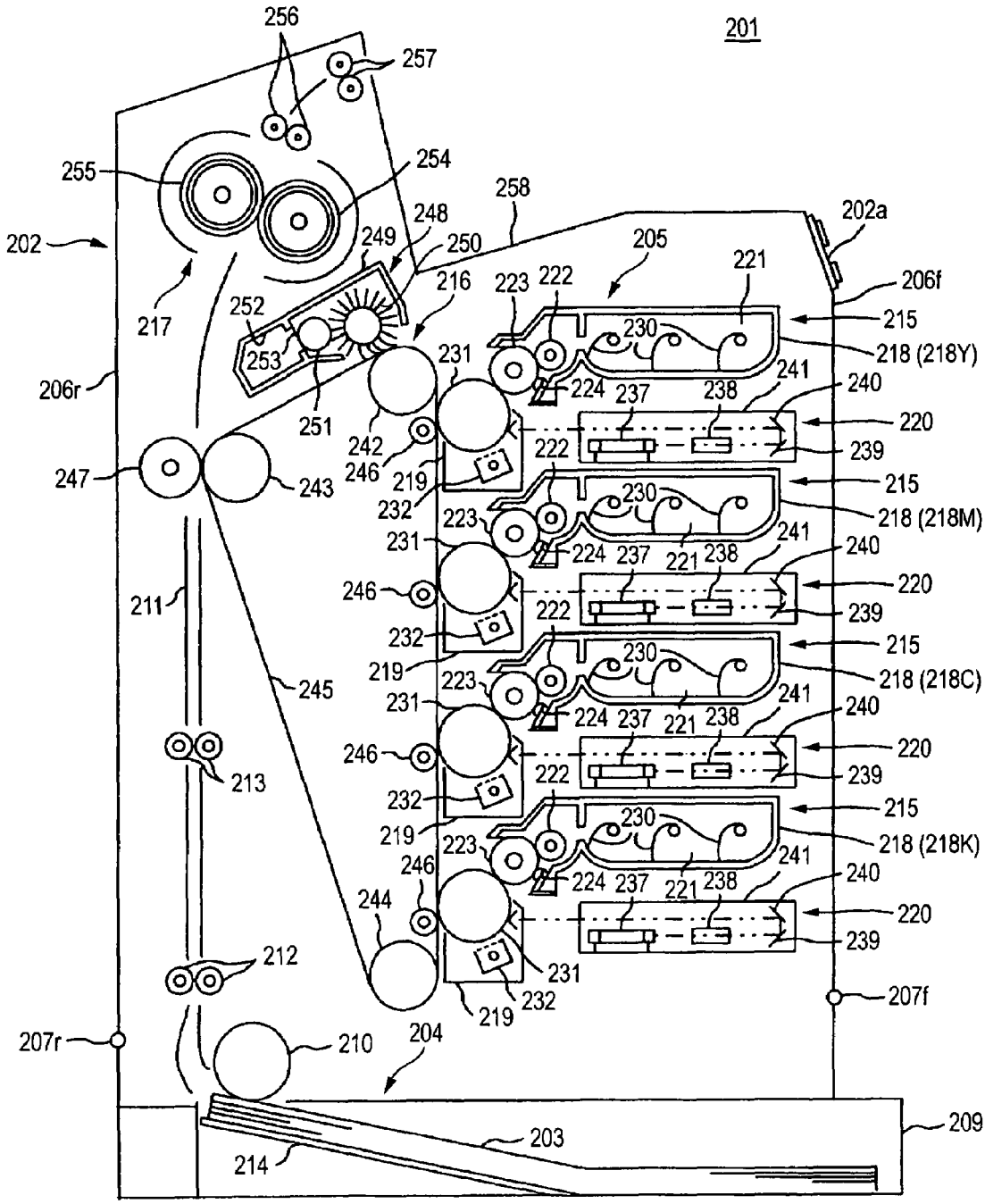
FIG. 7 is a cross sectional view showing another embodiment of a color laser printer as the apparatus for forming an image.
Figure 8:
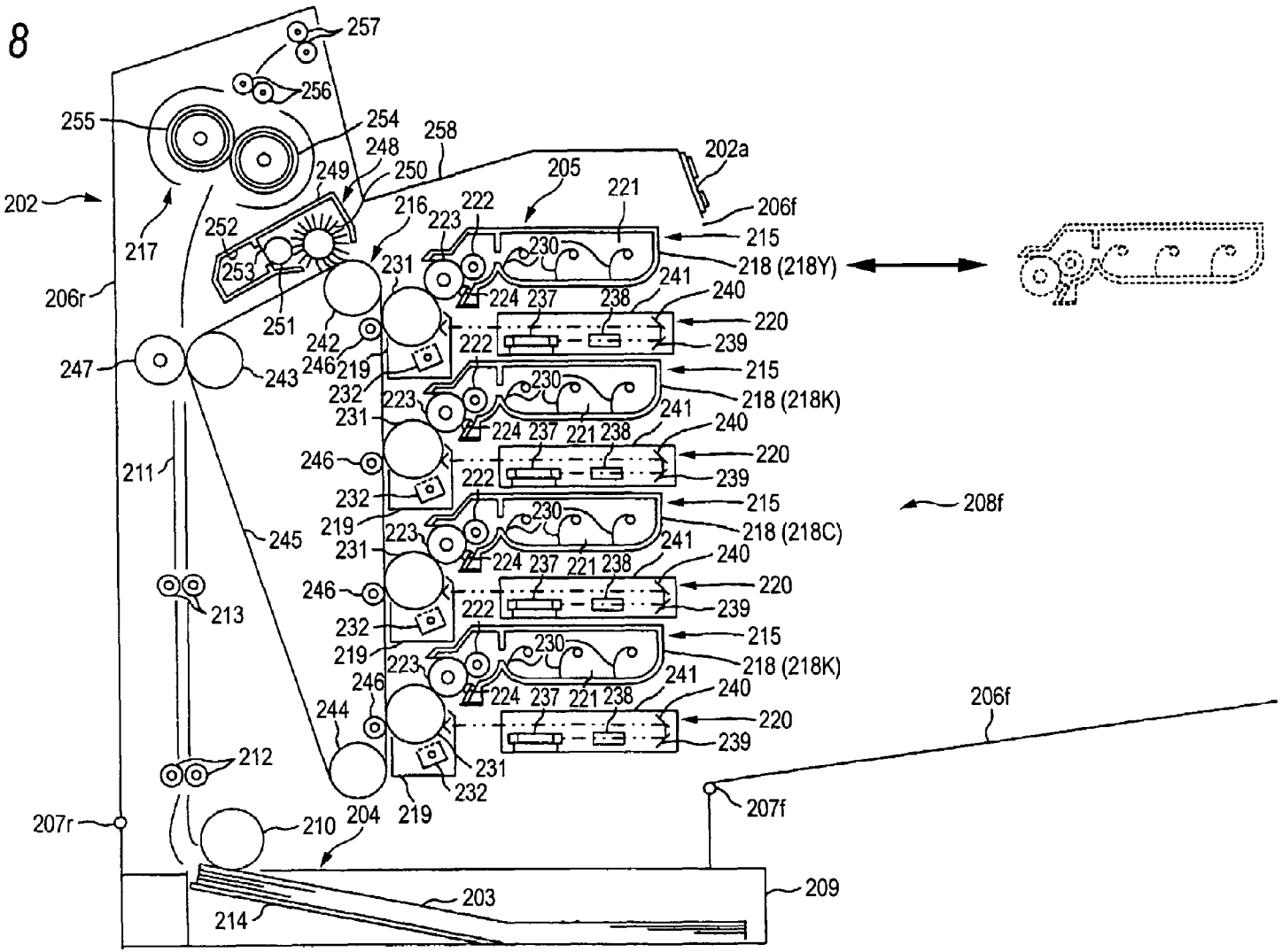
FIG. 8 is a cross sectional view showing the color laser printer shown in FIG. 7 in a state where a front cover thereof is opened.
Figure 9:
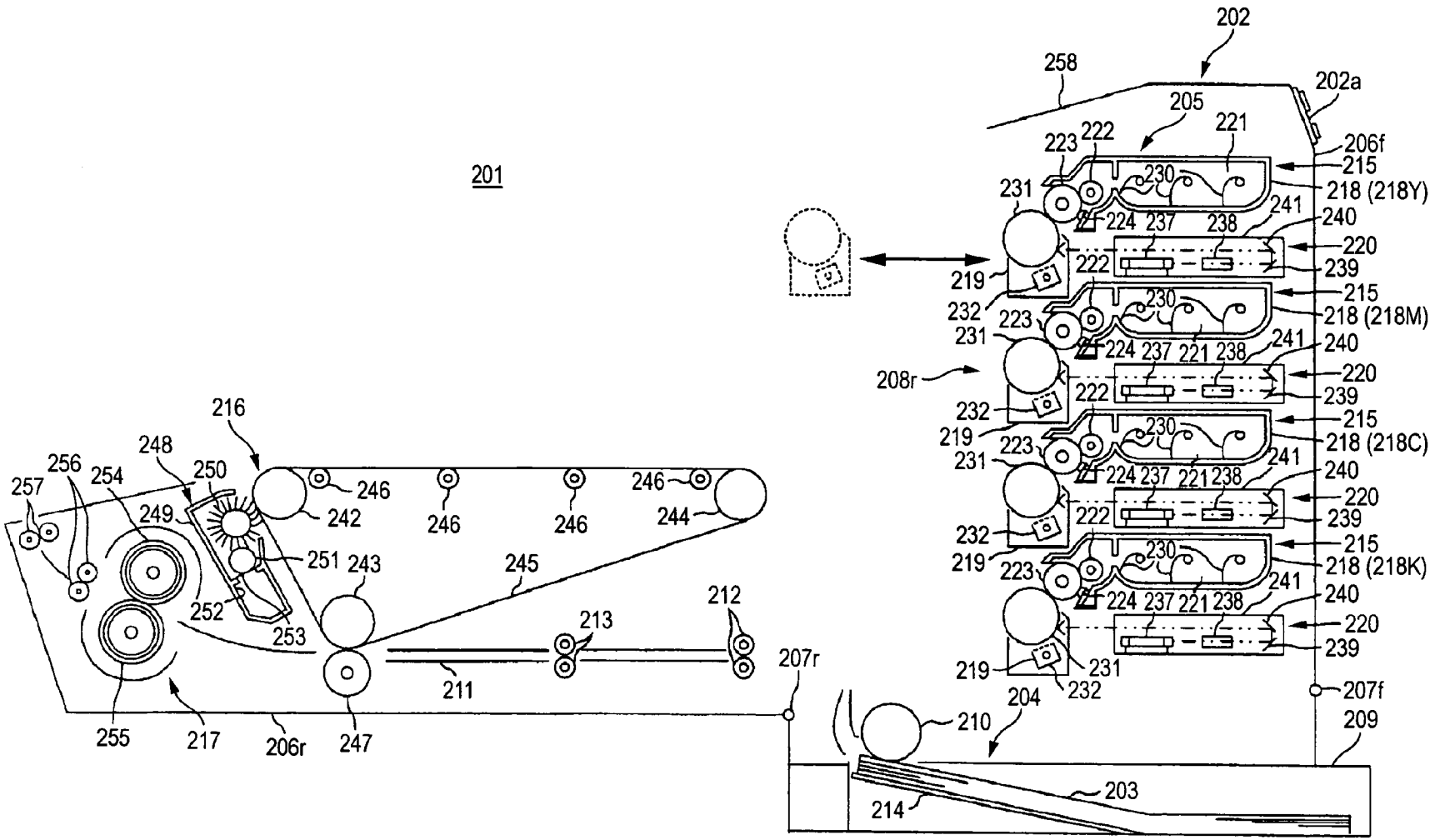
FIG. 9 is a cross sectional view showing the color laser printer shown in FIG. 7 in a state where a rear cover thereof is opened.
Figure 10:
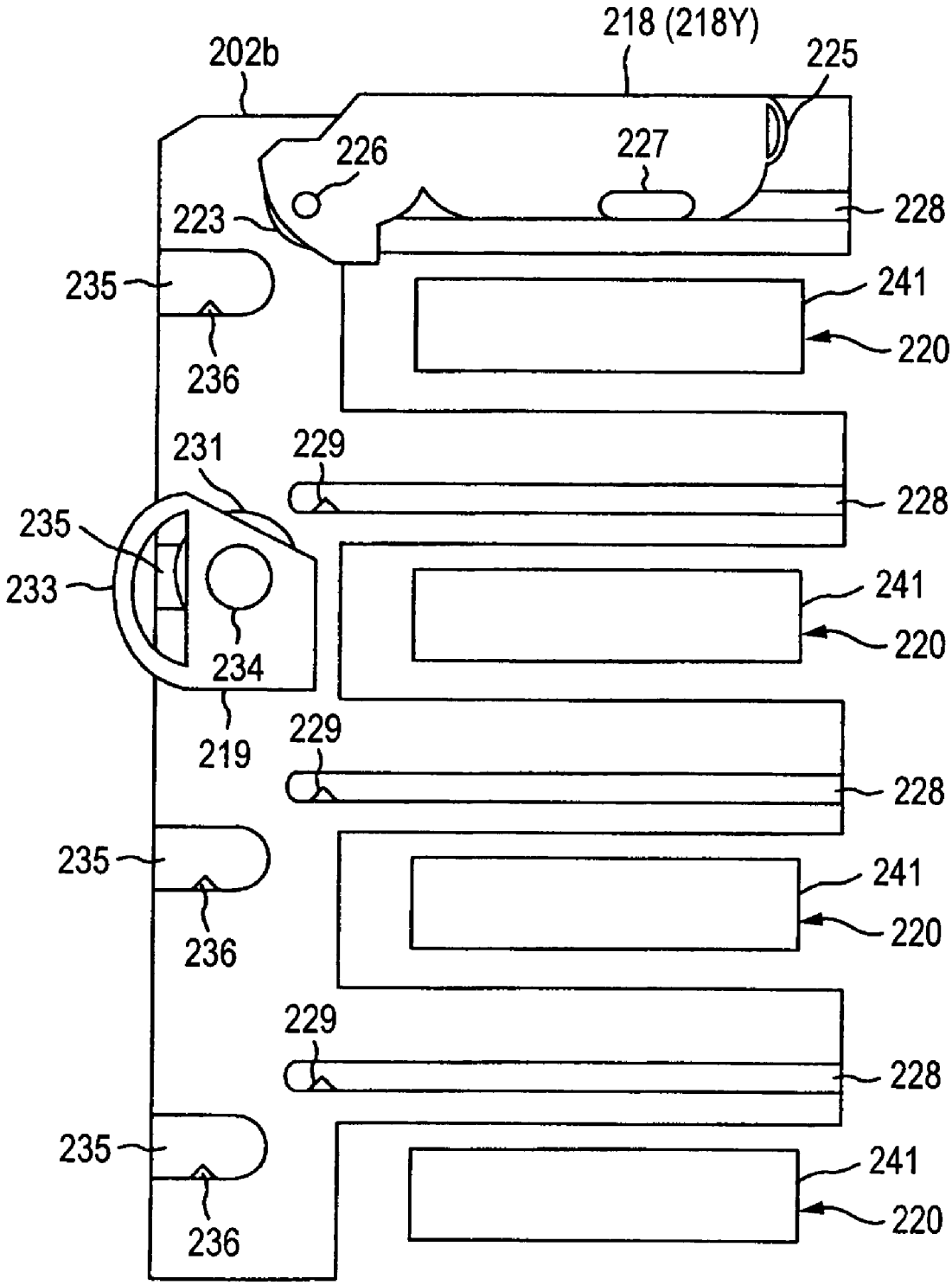
FIG. 10 is an enlarged cross sectional view showing a process part of the laser color printer shown in FIG. 7 (in a state where drum cartridges corresponding to a yellow developing cartridge and a magenta developing cartridge are mounted).

FIG. 7 is a cross sectional view showing a second embodiment of a color laser printer as an apparatus for forming an image. FIG. 8 is a cross sectional view showing the color laser printer shown in FIG. 7 in a state where a front cover thereof is opened. FIG. 9 is a cross sectional view showing the color laser printer shown in FIG. 7 in a state where a rear cover thereof is opened. FIG. 10 is an enlarged cross sectional view showing a process part of the laser color printer shown in FIG. 7 in a state where drum cartridges corresponding to a yellow developing cartridge and a magenta developing cartridge are mounted.

In FIG. 7, the color laser printer 201 is a tandem type vertical standing color laser printer with an intermediate transfer system, which contains, inside a mainframe casing 202, a feeder part 204 for feeding paper 203 as a transfer medium, and an image forming part 205 for forming an image on the paper 203 thus fed. In the following description, the right side in FIG. 1 having an operating part 202*a* provided is referred to as a front side of the color laser printer 201, and the left side is referred to as a rear side of the color laser printer 201.

The mainframe casing 202 has a substantially rectangular box shape and has a rear cover 206*r* as a first openable member and a front cover 206*f* as a second openable member on the rear side and the front side thereof, respectively. The mainframe casing 202 has, on an upper part on the front side, an operating panel 202*a* having a liquid crystal panel displaying operation state and the like of the color laser printer 201 and user operable buttons for setting configurations, as an operating part. A paper delivery tray 258 described later is provided on an upper part of the mainframe casing 202.

The front cover 206*f* has a plate shape, and one lower end thereof is connected to the mainframe casing 202 through a hinge 207*f*. According to the configuration, the front cover 206*f* is openably and closably swung with respect to the mainframe casing 202 with the hinge 207*f* as a supporting point. In the case where the front cover 206*f* is opened as shown in FIG. 8, the front side of the mainframe casing 202 is left open to form a front opening 208*f* as an opening, whereby consumable parts and the like can be replaced through the front opening 208*f*. In the case where the front cover 206*f* is closed as shown in FIG. 7, the color laser printer 201 is set up as a printable state.

The rear cover 206*r* has a plate shape, and one lower end thereof is connected to the mainframe casing 202 through a hinge 207*r*. According to the configuration, the rear cover 206*r* is openably and closably swung with respect to the mainframe casing 202 with the hinge 207*r* as a supporting point. In the case where the rear cover 206*r* is opened as shown in FIG. 9, the rear side of the mainframe casing 202 is left open to form a rear opening 208*r* as an opening, and whereby paper jam can be resolved, and consumable parts and the like can be replaced, through the rear opening 208*r*. In the case where the rear cover 206*r* is closed as shown in FIG. 7, the color laser printer 201 is set up as a printable state.

The feeder part 204 is provided at a bottom of the mainframe casing 202 as shown in FIG. 7, and contains a paper feeding tray 209 detachable in the cross direction of the mainframe casing 202, a paper feeding roller 210 disposed at an upper part of one end of the paper feeding tray 209, a paper feeding path 211, conveying rollers 212 provided on the paper feeding path 211 on the downstream side of the conveying direction of the paper 203 with respect to the paper feeding roller 210 (hereinafter, the upstream side and the downstream side of the conveying direction of the paper 203 are sometimes simply referred to as an upstream side and the downstream side, respectively), and resist rollers 213 provided on the paper feeding path 211 on the downstream side of the conveying direction of the paper 203 with respect to the conveying rollers 212.

The paper feeding tray 209 has a box shape having an open upper surface and is equipped with a paper pressing plate 214, on which the paper 203 is stacked. The paper pressing plate 214 is provided in the paper feeding tray 209 with one end thereof facing the paper feeding roller 210 being vertically swingable. On the paper pressing plate 214, the paper 203 is stacked. The paper pressing plate 214 is biased from the back surface thereof with a spring, which is not shown in the figure, and the uppermost paper 203 stacked on the paper pressing plate 214 is pressed with the spring onto the paper feeding roller 210 and is fed one by one to the paper feeding path 211 through rotation of the paper feeding roller 210.

The paper feeding path 211 extends upward from the end of the upstream side where the paper feeding roller 210 is provided, along the rear cover 206*r* in the mainframe casing 202, through a transferring position (a position where a secondary transfer roller 247 and a first intermediate transfer material supporting roller 243, which will be described later, are in contact with each other), to reach the end of the downstream side where a fixing part, which will be described later, is provided.

The conveying rollers 212 and the resist rollers 213 are disposed on the upstream side and the downstream side of the conveying direction, respectively, to face the paper feeding path 211.

The paper 203 fed with the paper feeding roller 210 to the paper feeding path 211 is conveyed with the conveying rollers 212 from the upstream side to the downstream side of the conveying direction, and then conveyed with the resist rollers 213 to the transferring position after resisted.

The image forming part 205 contains a process part 215, an intermediate transfer mechanism part 216 as a transfer unit, and a fixing part 217.

The process part 215 contains a developing cartridge 218 as a developing part, a drum cartridge 219 as an image carrying part, and a scanner unit 220 as an exposing unit, and plural (four) process parts for each of colors are provided. The process parts are disposed in parallel to each other and are aligned with prescribed intervals in a substantially vertical direction.

The developing cartridges 218 contain four developing cartridge, a yellow developing cartridge 218Y, a magenta developing cartridge 218M, a cyan developing cartridge 218C and a black developing cartridge 218K, and the developing cartridges 218, which will be described in detail later, are independently detachable to the mainframe casing 202 through the front opening 208*f* formed in the state where the front cover 206*f* is opened.

The developing cartridges 218 are formed as casings, each contains a toner housing part 221 as a developer housing chamber, a feeding roller 222, a developing roller 223 as a developer carrying member, and a squeezing plate 224.

The developing cartridge 218 has a grabbing member 225 at the front end thereof, and a first developing-side guide projection 226 and a second developing-side guide projection 227 are provided at both side ends in the width direction (a direction perpendicular to the cross direction on the plane view, wherein after the same) of the developing cartridge 218. The developing cartridge 218 has an opening on the rear side of the bottom thereof to expose a part of the developing roller 223.

The grabbing member 225 has a substantially arc shape on the side view and protrudes toward the front on the front end of the developing cartridge 218. Two grabbing members 225 are provided as opposed to each other on both sides in the width direction of the developing cartridge 218, i.e., both sides in the axial direction of the developing roller 223.

The first developing-side guide projection 226 is configured by extending the axis of the developing roller 223 in the longitudinal direction thereof to protrude from the both side surfaces in the width direction of the developing cartridge 218.

The second developing-side guide projection 227 has a substantially elliptic plate shape on the side view extending in the longitudinal direction of the developing cartridge 218, and protrudes from the front side of the bottom end of each of the both side surfaces in the width direction of the developing cartridge 218 in the directions extending outward in the width direction.

The first developing-side guide projections 226 and second developing-side guide projections 227 are engaged with first guide channels 228 as a guide part formed on side plates 202*b* provided on both inside side surfaces in the width direction of the mainframe casing 202.

The first guide channels 228 are provided in parallel to each other on the mainframe casing 202 with a prescribed interval in the substantially vertical direction, and extend in the cross direction on the mainframe casing 202 at the mounting position of the developing cartridge 218, i.e., in the detaching direction of the developing cartridge 218, and more specifically in the direction along an upper surface of a scanner casing 241 of the scanner unit 220 described later. Further specifically, the first guide channel 228 is a channel extending in the substantially horizontal direction, in which the front end thereof is opened toward the front opening 208*f* in the state where the front cover 206*f* is opened, and in the case where the first developing-side guide projection 226 is positioned at the rear end (the deepest part) of the first guide channel 228, the developing roller 223 faces and in contact with the photoreceptor drum 231.

The rear end of the first guide channel 228 is provided with a positioning projection 229.

The positioning projection 229 has a substantially triangular shape and provided on the lower surface of the first guide channel 228. The positioning projection 229 is elastically biased toward the upper surface of the first guide channel 228 with a spring, which is not shown in the figure.

In a state where the developing cartridge 218 is mounted in the mainframe casing 202, the first developing-side guide projection 226 of the developing cartridge 218 is engaged with the first guide channel 228 at the rear end thereof as being restrained from moving to the front with the positioning projection 229, and the second developing-side guide projection 227 is engaged with the first guide channel 228 at the front end thereof. In this state, the developing roller 223 of the developing cartridge 218 is made in contact under pressure with a photoreceptor drum 231 of a drum cartridge 219 described later.

The toner housing part 221 is formed as an interior space of the developing cartridge 218, in which plural agitators 230 (for example, three agitators in this embodiment) are provided in the cross direction of the toner housing part 221 as shown in FIG. 7. The toner housing parts 221 of the respective developing cartridges 218 are charged with a positively charged non-magnetic one-component toner of yellow color for the yellow developing cartridge 218Y, that of magenta color for the magenta developing cartridge 218M, that of cyan color for the cyan developing cartridge 218C, and that of black color for the black developing cartridge 218K, respectively. The toner used herein may be a substantially spherical polymerized toner obtained by polymerizing a polymerizable monomer, such as a styrene monomer, e.g., styrene, and an acrylic monomer, e.g., acrylic acid, an alkyl (having from 1 to 4 carbon atoms) acrylate ester and an alkyl (having from 1 to 4 carbon atoms) methacrylate ester, by a known polymerization method, such as suspension polymerization. The toner contains a coloring agent corresponding to the respective colors and wax and is improved in flowability by adding an external additive, such as silica. The toner generally has a particle diameter of about from 6 to 10 μm.

The toner contained in the toner housing part 221 is discharged toward the feeding roller 222 through a toner feeding outlet opening on the side surface of the toner housing part 221 by rotation and agitation of the agitators 231 provided in the toner housing part 221.

The feeding roller 222 is rotatablly disposed on the side of the toner feeding outlet, and the developing roller 223 is rotatablly disposed on the side of the feeding roller 222 to face the feeding roller 222. The feeding roller 222 and the developing roller 223 are rotatablly supported on the developing cartridge 218 in a state where they are in contact with each other under compression to certain extent.

The feeding roller 222 is configured by covering a metallic roller axis with a roller formed with an electroconductive sponge member.

The developing roller 223 is configured by covering a metallic roller axis with a roller formed with an electroconductive rubber material as an elastic member. More specifically, the roller of the developing roller 223 has a two-layer structure containing an elastic roller formed with urethane rubber, silicone rubber, EPDM rubber or the like having electroconductivity with carbon fine particles or the like, having coated on the surface thereof a coating layer mainly containing urethane rubber, a urethane resin, a polyimide resin or the like. The developing roller 223 is disposed in such a manner that a lower part thereof is exposed downward from an opening of the developing cartridge 218 (as shown in FIG. 10), and upon developing, the developing roller 223 is applied with a developing bias voltage from an electric power source, which is not shown in the figure.

The squeezing blade 224 has a blade mainframe formed with a metallic leaf spring material and a pressing part having a hemicyclic cross section formed with insulating silicone rubber. One end of the blade mainframe is supported by the developing cartridge 218 in the vicinity of the developing roller 223, and the pressing part is in contact with the developing roller 223 under pressure by the elastic force of the blade mainframe.

The toner discharged from the toner feeding outlet is fed to the developing roller 223 through rotation of the feeding roller 222, and is charged positively through friction between the feeding roller 222 and the developing roller 223. The toner thus fed to the developing roller 223 intervenes between the pressing part of the squeezing blade 224 and the developing roller 223 associated with rotation of the developing roller 223 and is consequently carried as a thin layer having a constant thickness on the developing roller 223.

The drum cartridges 219 are disposed below the oblique rear parts of the developing cartridges 218 in the respective process parts 215 for each colors, and are independently detachable to the mainframe casing 202 through the rear opening 208*r*, which is formed upon opening the rear cover 206*r*, while the configurations will be described in detail later.

The drum cartridges 219 are formed as casings, each contains a photoreceptor drum 231 as an image carrying member and a scorotron charging device 232. The drum cartridge 219 is provided with a grabbing member 233 at a rear end thereof as shown in FIG. 10, and is provided with drum-side guide projections 234 as an engaging part on both sides in the width direction. The drum cartridge 219 has an opening on the front side of the top thereof to expose a part of the photoreceptor drum 231.

The grabbing member 233 has a substantially arc shape on the side view and protrudes toward the rear on the rear end of the drum cartridge 219. Two grabbing members 233 are provided as opposed to each other on both sides in the width direction of the drum cartridge 219, i.e., both sides in the axial direction of the photoreceptor drum 231.

The drum-side guide projection 234 has a substantially cylindrical shape and protrudes from both side surfaces of the drum cartridge 219 at the substantially center part of the drum cartridge 219 in the direction extending outward in the width direction. It is effective for improving the positional accuracy that the drum-side guide projection 234 is used as a rotation axis of the photoreceptor drum 231. Specifically, bearings are provided on both ends of the photoreceptor drums and are engaged with the drum-side guide projections 234, whereby the number of components can be decreased, and the positional accuracy can be improved.

The drum-side guide projections 234 are engaged with second guide channels 235 formed on side plates 202*b*provided on both sides in the width direction inside the mainframe casing 202.

The second guide channels 235 are provided in parallel to each other on the mainframe casing 202 with a prescribed interval in the substantially vertical direction, and extend in the cross direction on the mainframe casing 202 at the mounting position of the drum cartridge 219, i.e., in the detaching direction of the drum cartridge 219. More specifically, the second guide channel 235 is a channel extending in the substantially horizontal direction, in which the rear end thereof is opened toward the rear opening 208*r* in the state where the rear cover 206*r* is opened, and in the case where the drum-side guide projection 234 is positioned at the front end (the deepest part) of the second guide channel 235, the developing roller 223 faces and in contact with the photoreceptor drum 231.

The front end of the second guide channel 235 is provided with a positioning projection 236.

The positioning projection 236 has a substantially triangular shape and provided on the lower surface of the second guide channel 235. The positioning projection 236 is elastically biased toward the upper surface of the second guide channel 235 with a spring, which is not shown in the figure.

In a state where the drum cartridge 219 is mounted in the mainframe casing 202, the drum-side guide projection 234 of the drum cartridge 219 is engaged with the second guide channel 235 at the front end thereof as being restrained from moving to the rear with the positioning projection 236.

The photoreceptor drum 231 is rotatablly disposed on the drum cartridge 219 in a state where it is in contact with the developing roller 223 below the oblique rear of the developing roller 223, and is configured with a grounded drum mainframe having on the surface thereof a photosensitive layer formed with an organic photoreceptor mainly containing polycarbonate.

The scorotron charging device 232 is disposed under the photoreceptor drum 231 with a prescribed distance for preventing from being in contact with each other. The scorotron charging device 232 is a scorotron type charging device generating corona discharge from a charging wire, such as tungsten, and is fixed to the drum cartridge 219 for uniformly charging the surface of the photoreceptor drum 231 positively.

The scanner unit 220 is configured as a laser scanner, and contains inside a scanner casing 241 as a casing, a laser light emitting part, which is not shown in the figure, a polygonal mirror 237 rotationally driven, a lens 238, and a reflecting mirrors 239 and 240. The scanner unit 220 is disposed in the process part 215 under the developing cartridge and on the side (front side) of the photoreceptor drum opposite to the side of the transferring position.

The scanner casing 241 has a substantially rectangular shape on the side view and is disposed to overlap horizontally the photoreceptor drum 231 and fixed to the mainframe casing 202. According to the configuration, the developing cartridges 218 and the scanner units 220 are not horizontally overlapped but are vertically overlapped alternately, and the developing cartridge 218 is detachable along the upper surface of the scanner casing 241 of the scanner unit 220.

The scanner unit 220 transmits or reflects a laser beam based on image data emitted from a laser light emitting part by the polygonal mirror 237, the lens 238 and the reflecting mirrors 239 and 240, in this order, whereby the surface of the photoreceptor drum 231 is irradiated therewith by rapid scanning.

The toners of the respective colors are subjected to exposure and development in the following manner in the process parts 215. The surface of the photoreceptor drum 231 is uniformly charged positively with the scorotron charging device 232 associated with rotation of the photoreceptor drum 231, and then exposed by light emitted from the scanner unit 220 to form an electrostatic latent image based on the image data. Subsequently, the toner thus positively charged and carried on the developing roller 223 is electrically moved, upon contacting with the photoreceptor drum 231 associated with rotation of the developing roller 223, onto the electrostatic latent image formed on the surface of the photoreceptor drum 231, i.e., such a region on the surface of the photoreceptor drum that has a lower electric potential due to exposure with the scanner unit 220, and carried thereon, whereby a toner image is formed on the surface of the photoreceptor drum 231. As a result, reversal development is completed.

The intermediate transfer mechanism part 216 is provided in the mainframe casing 202 on the rear side of the process parts 215 on the side of the drum cartridges 219 opposite to the scanner units 220, and contains an intermediate transfer material driving roller 242, a first intermediate transfer material supporting roller 243, a second intermediate transfer material supporting roller 244, an intermediate transfer belt 245 formed with an endless belt, a primary transfer roller 246, a secondary transfer roller 247 and a belt cleaner 248.

The intermediate transfer material driving roller 242 is rotatablly disposed in the mainframe casing 202 on the oblique rear of the photoreceptor drum 231 of the drum cartridge 219 provided corresponding to the yellow developing cartridge 218Y with the intermediate transfer belt 245 intervening therebetween.

The first intermediate transfer material supporting roller 243 is rotatablly disposed below the oblique rear of the intermediate transfer material driving roller 242, and disposed to face the secondary transfer roller 247 with the intermediate transfer belt 245 intervening therebetween.

The second intermediate transfer material supporting roller 244 is rotatablly disposed in the mainframe casing 202 below the intermediate transfer material driving roller 242 in the substantially vertical direction.

The intermediate transfer material driving roller 242, the first intermediate transfer material supporting roller 243 and the second intermediate transfer material supporting roller 244 are disposed to make a substantially triangular arrangement, around which the intermediate transfer belt 245 is wound.

The intermediate transfer belt 245 is formed with an electroconductive resin, such as polycarbonate and polyimide, having electroconductive particles, such as carbon, dispersed therein, and is disposed in parallel to the photoreceptor drums 231 in such a manner that the contact surface on the front side of the wound intermediate transfer belt 245 faces and is in contact with all the photoreceptor drums 231 of the drum cartridges 219.

In the intermediate transfer mechanism part 216, a driving force is transmitted from a main motor, which is not shown in the figure, to the intermediate transfer material driving roller 242 to rotate the intermediate transfer material driving roller 242, and the first intermediate transfer material supporting roller 243 and the second intermediate transfer material supporting roller 244 are driven thereby, whereby the intermediate transfer belt 245 wound on the intermediate transfer material driving roller 242, the first intermediate transfer material supporting roller 243 and the second intermediate transfer material supporting roller 244 is rotationally driven in the same direction as the photoreceptor drums 231 of the drum cartridges 219 on the contact surface facing and in contact with the photoreceptor drums 231.

The primary transfer rollers 246 are disposed inside the intermediate transfer belt 245 thus wound to face the photoreceptor drums 231 of the drum cartridges 219 with the intermediate transfer belt 245 intervening therebetween. The primary transfer roller 246 is configured by covering a metallic roller axis with a roller formed with an elastic member, such as an electroconductive rubber material. The primary transfer roller 246 is rotatablly disposed to rotate in the same direction as the rotational moving direction of the intermediate transfer belt 245 on the contact surface facing and in contact with the intermediate transfer belt 245, and is applied with a transfer bias voltage upon transferring from an electric power source, which is not shown in the figure.

The secondary transfer roller 247 is disposed to be in contact with the intermediate transfer belt 245 and to face the first intermediate transfer material supporting roller 243 with the intermediate transfer belt 245 intervening therebetween. The secondary transfer roller 247 is configured by covering a metallic roller axis with a roller formed with an elastic member, such as an electroconductive rubber material. The secondary transfer roller 247 is rotatablly disposed to rotate in the same direction as the rotational moving direction of the intermediate transfer belt 245 on the contact surface facing and in contact with the intermediate transfer belt 245, and is applied with a transfer bias voltage upon transferring from an electric power source, which is not shown in the figure.

The belt cleaner 248 is disposed to face the intermediate transfer material driving roller 242 of the intermediate transfer mechanism part 216 with the intermediate transfer belt 245 intervening therebetween, and has, in a cleaner casing 249 disposed on the way from the first intermediate transfer material supporting roller 243 to the intermediate transfer material driving roller 242, a cleaner brush 250, a recovering roller 251, a recovering box 252 and a scraper 253.

The cleaner brush 250 has a cylindrical mainframe having brush formed radially, and is rotationally disposed in such a state that the brush faces and is in contact with the intermediate transfer belt 245 in the course of from the first intermediate transfer material supporting roller 243 to the intermediate transfer material driving roller 242. The cylindrical mainframe of the cleaner brush 250 is applied with a cleaning bias voltage to form an electric potential difference with respect to the intermediate transfer belt 245 from an electric power source, which is not shown in the figure, upon cleaning.

The recovering roller 251 is formed with a metallic roller and is rotatablly disposed on the side of the cleaner brush 250 to face and be in contact with the cleaner brush 250. The recovering roller 251 is applied with a recovering bias voltage to form an electric potential difference with respect to the cleaner brush 250 from an electric power source, which is not shown in the figure, upon cleaning.

The recovering box 252 is disposed on the side of the recovering roller 251 and has an opening on a part facing the recovering roller 251. The scraper 253 is provided in the vicinity of the opening and is in contact with the recovering roller 251 under pressure.

The monochrome toner images formed on the photoreceptor drums 231 are transferred to the intermediate transfer belt 245 at the time when they face the intermediate transfer belt 245, and are sequentially accumulated on the intermediate transfer belt 245 to form a color image.

Specifically, a yellow toner image formed on the photoreceptor drum 231 of the yellow developing cartridge 218Y is transferred on the intermediate transfer belt 245, and then a magenta toner image formed on the photoreceptor drum 231 of the magenta developing cartridge 218M is transferred to the intermediate transfer belt 245 to overlap the yellow toner image having been transferred. A cyan toner image formed by the cyan developing cartridge 218C and a black toner image formed by the black developing cartridge 218K are then sequentially transferred in the same procedures to form a color image on the intermediate transfer belt 245.

The color image thus formed on the intermediate transfer belt 245 is transferred to paper 203 at once during a period when the paper 203 passes through between the intermediate transfer belt 245 and the secondary transfer roller 247 in contact therewith.

The toner attached to the intermediate transfer belt 245 after transferring the color image to the paper 203 is scraped with and attached to the cleaner brush 250 by the cleaning bias voltage applied to the cleaner brush 250 when the toner faces the cleaner brush 250. Thereafter, the toner attached to the cleaner brush 250 is attached to the recovering roller 251 by the recovering bias voltage applied to the recovering roller 251 when the toner faces the recovering roller 251, and then the toner is scraped with the scraper 253 and recovered into the recovering box 252.

In the color laser printer 201, the remaining toner is recovered by the so-called cleaner less developing system, in which the toner remaining on the surface of the photoreceptor drum 231 is recovered with the developing roller 223. Specifically, the photoreceptor drum 231 is charged with the scorotron charging device 232 at the charging position associated with rotation of the photoreceptor drum 231, and then exposed with the scanner unit 220 at the exposing position. When the remaining toner on the surface of the photoreceptor drum 231 reaches the developing position where the developing roller 223 and the photoreceptor drum 231 are in contact with each other, the remaining toner present on a non-exposed region is moved to and recovered by the developing roller 223 through the developing bias voltage. In the case where the remaining toner is present on an exposed region, it forms a toner image along with a toner that is newly moved from the developing roller 223 to the exposed region.

The peripheral velocity of the developing roller 223 is set at 1.6 times the peripheral velocity of the photoreceptor drum 231. The difference in peripheral velocity facilitates recovery of the remaining toner from the photoreceptor drum 231 to the developing roller 223. The polymerized toner remains in a small amount owing to the good flowability thereof and is easily recovered by the developing roller 223.

According to the formation of a color image described in the foregoing; the color laser printer 201 has a tandem type system having plural photoreceptor drums 231 for respective colors, and therefore, toner images of respective colors are formed at a speed equivalent to formation of a monochrome image, so as to attain rapid formation of a color image.

The fixing part 217 is disposed above the intermediate transfer mechanism part 216 and contains a first heating roller 254 in contact with the surface of the paper having a color image transferred thereon, a second heating roller 255 disposed to face the first heating roller 254 with the paper 203 intervening therebetween and being in contact with the back surface of the paper 203, and a pair of conveying rollers 256 disposed above the first heating roller 254 and the second heating roller 255.

The first heating roller 254 contains a cylindrical metallic tube, such as aluminum, a halogen heater for heating provided therein, and an elastic layer formed outside the tube. The second heating roller 255 contains, as similar to the first heating roller 254, a cylindrical metallic tube, such as aluminum, a halogen heater for heating provided therein, and an elastic layer formed outside the tube, and is disposed to press the first heating roller 254.

The color image thus transferred on the paper 203 is thermally fixed thereon with the first heating roller 254 and the second heating roller 255 during a period when the paper 203 passes through between the first heating roller 254 and the second heating roller 255, and then the paper 203 is conveyed with the conveying rollers 256 to paper delivery rollers 257.

The paper delivery rollers 257 are disposed above the conveying roller 256 and in the vicinity of a paper delivery outlet, and the paper 3 thus conveyed with the conveying roller 256 is delivered in the direction from the rear side to the front side to the paper delivery tray 258 with the paper delivery rollers 257.

In the color laser printer 201, the paper feeding path 211, the conveying rollers 212, the resist rollers 213, the intermediate transfer mechanism part 216, the fixing part 217 and the paper delivery rollers 257 are integrally retained by the rear cover **206*r*. According to the configuration, in the case where the rear cover 206*r* is opened as shown in FIG. 9, the paper feeding path 211, the conveying rollers 212, the resist rollers 213, the intermediate transfer mechanism part 216, the fixing part 217 and the paper delivery rollers 257 are integrally moved along with the rear cover 206*r* thus opened, whereby the intermediate transfer belt 245 of the intermediate transfer mechanism part 216 is substantially horizontally disposed. In the case where the rear cover 206*r* is opened as shown in FIG. 7, the intermediate transfer belt 245 of the intermediate transfer mechanism part 216 is substantially vertically disposed, and the intermediate transfer belt 245 is in contact with the photoreceptor drums 231** under pressure.

In the color laser printer 201 having the aforementioned configuration, the developing cartridges 218 and the drum cartridges 219 can be independently detached. For example, in the case where only the developing cartridge 218 is to be detached, the front cover **206*f* is opened as shown in FIG. 8, so as to form a front opening 208*f*, through which the developing cartridges 218 and the scanner units 220 are exposed on the front side of the mainframe casing 202**.

In the case where the developing cartridge 218 mounted in the mainframe casing 202 is removed from the mainframe casing 202, the grabbing member 225 of the developing cartridge 218 is grasped as shown in FIG. 10, and the developing cartridge 218 is withdrawn from the mainframe casing 202 to the front side. The first developing-side guide projection 226 disposed at the rear end of the first guide channel 228 overstrides the positioning projection 229 by pressing down the positioning projection 229 against the bias force of the positioning projection 229, and is guided to the front side along the first guide channel 228. The developing cartridge 218 is moved to the front side with the second developing-side guide projection 227 is guided to the front side along the first guide channel 228, and then the developing cartridge 218 is removed from the mainframe casing 202 and taken out through the front opening **208*f*, as shown by a virtual image shown by broken lines in FIG. 8**.

In the case where the developing cartridge 218 is mounted on the mainframe casing 202, the front cover **206*f* is opened, and while the developing cartridge 218 is inserted into the mainframe casing 202 through the front opening 208*f* by grasping the grabbing member 225 of the developing cartridge 218, the first developing-side guide projection 226 is engaged with the first guide channel 228, and then the second developing-side guide projection 227 is engaged with the first guide channel 228. Thereafter, the developing cartridge 218 is pressed onto the rear side of the mainframe casing 202, whereby the developing cartridge 218 is moved to the rear side with the first developing-side guide projection 226 and the second developing-side guide projection 227 being guided to the rear side along the first guide channel 228. Subsequently, the first developing-side guide projection 226 overstrides the positioning projection 229 by pressing down the positioning projection 229 against the bias force of the positioning projection 229, and is retained at the rear end of the first guide channel 228 in a state where it is restrained from moving to the front with the positioning projection 229. In this state, the developing roller 223 of the developing cartridge 218 is in contact with the photoreceptor drum 231** under pressure.

In the case where the drum cartridge 219 is detached, for example, the rear cover **206*r* is opened, and the intermediate transfer belt 245 of the intermediate transfer mechanism part 216 is substantially horizontally disposed as shown in FIG. 9, so as to form the rear opening 208***r*, through which the drum cartridges 219 are exposed on the rear side of the mainframe casing 202.

In the case where the drum cartridge 219 mounted in the mainframe casing 202 is removed from the mainframe casing 202, the grabbing member 233 of the drum cartridge 219 is grasped as shown in FIG. 10, and the drum cartridge 218 is withdrawn from the mainframe casing 202 to the rear side. The drum-side guide projection 234 disposed at the front end of the second guide channel 235 overstrides the positioning projection 236 by pressing down the positioning projection 236 against the bias force of the positioning projection 236, and is guided to the rear side along the second guide channel 235, and the drum cartridge 219 is moved to the rear side. The drum cartridge 219 is then removed from the mainframe casing 202 and taken out through the rear opening 208*r*, as shown by a virtual image shown by broken lines in FIG. 9.

In the case where the drum cartridge 219 is mounted on the mainframe casing 202, the rear cover 206*r* is opened, and while the drum cartridge 219 is inserted into the mainframe casing 202 through the rear opening 208*r* by grasping the grabbing member 233 of the drum cartridge 219, the drum-side guide projection 234 is engaged with the second guide channel 235. Thereafter, the drum cartridge 218 is pressed onto the front side of the mainframe casing 202, whereby the drum cartridge 218 is moved to the front side with the drum-side guide projection 234 being guided to the front side along the second guide channel 235. Subsequently, the drum-side guide projection 234 overstrides the positioning projection 236 by pressing down the positioning projection 236 against the bias force of the positioning projection 236, and is retained at the front end of the second guide channel 235 in a state where it is restrained from moving to the rear with the positioning projection 236. In this state, the photoreceptor drum 231 of the drum cartridge 219 is in contact with the developing roller 223 under pressure.

Upon detaching the developing cartridge 218 or the drum cartridge 219 as described in the foregoing, the developing roller 223 and the photoreceptor drum 231 having been in contact with each other are not in friction with each other, whereby they can be effectively prevented from being damaged.

In the color laser printer 201, accordingly, the developing cartridges 218 and the drum cartridges 219 can be detached from the mainframe casing 202 in the directions substantially opposite to each other, whereby in the case where the toner is emptied out, only the developer cartridge 218 is replaced, but the expensive drum cartridge 219 can be used until the service life thereof is expired. Therefore, the running cost can be reduced. Furthermore, only the developing cartridge 218 is necessarily discarded to reduce the amount of industrial waste, whereby the color laser printer 201 good for the environment can be provided. In the color laser printer 201, moreover, the developing cartridges 218 and the drum cartridges 219 can be detached in the directions substantially opposite to each other, whereby the developing cartridges 218 and the drum cartridges 219 can be independently replaced while interference between them. Furthermore, the degrees of freedom in detaching directions of the developing cartridges 218 and the drum cartridges 219 upon replacement are increased, whereby the developing cartridges 218 and the drum cartridges 219 can be replaced without moving the scanner units for exposing the drum cartridges 219, and the developing cartridges 218 with a high replacement frequency can be replaced from the front side provided with the operating panel 202*a*, which is easily accessed in comparison to the photoreceptor drums 231.

In the color laser printer 201, the developing cartridges 218 can be smoothly replaced through the front opening 208*f* formed upon opening the front cover 206*f*. Accordingly, the developing cartridges 218 with a high replacement frequency can be detached from the front side provided with the operating panel 202*a*, whereby the operationality can be improved. In the color laser printer 201, particularly, all the detaching direction of the paper feeding tray 209, the delivery direction of the paper 203, the operation direction of the operating panel 202*a* and the detaching direction of the developing cartridges 218 are the same direction, and thus, the operationality is further improved.

In the color laser printer 201, the developing cartridges 218 and the scanner units 220 do not horizontally overlap each other and are disposed alternately in the vertical direction, and the developing cartridge 218 can be detached along the upper surface of the scanner casing 241 through engagement of the first guide channel 228 with the first developing-side guide projection 226 and the second developing-side guide projection 227. Accordingly, the developing cartridges 218 can be detached without interfering with the scanner units 220, and thus the developing cartridges 218 can be easily replaced.

In the color laser printer 201, the scanner unit 220 is provided on the side of the photoreceptor drum 231 opposite to the transferring position to overlap the photoreceptor drum 231 horizontally, whereby the scanner units 220 can be disposed, and the apparatus can be miniaturized, without impairing replacement of the developing cartridges 218 and the drum cartridges 219.

In the color laser printer 201, the intermediate transfer mechanism part 216 is supported by the rear cover 206*r*, whereby the drum cartridges 219 can be smoothly detached through the rear opening 208*r* formed upon opening the rear cover 206*r*.

The color laser printer 201 employs the cleanerless developing system, in which the remaining toner remaining on the photoreceptor drum 231 after transferring the toner image carried on the photoreceptor drum 231 to the intermediate transfer belt 245 is recovered by the developing roller 223, whereby a waste toner storage for recovering and storing the remaining toner is not necessary. Accordingly, the configuration of the apparatus can be simplified, and the apparatus can be miniaturized. As a result, the developing cartridge 218 and the scanner unit 220 can be disposed to overlap substantially vertically owing to the absence of the space for providing a waste toner storage, whereby the footprint of the color laser printer 201 can be reduced.

Figure 11:
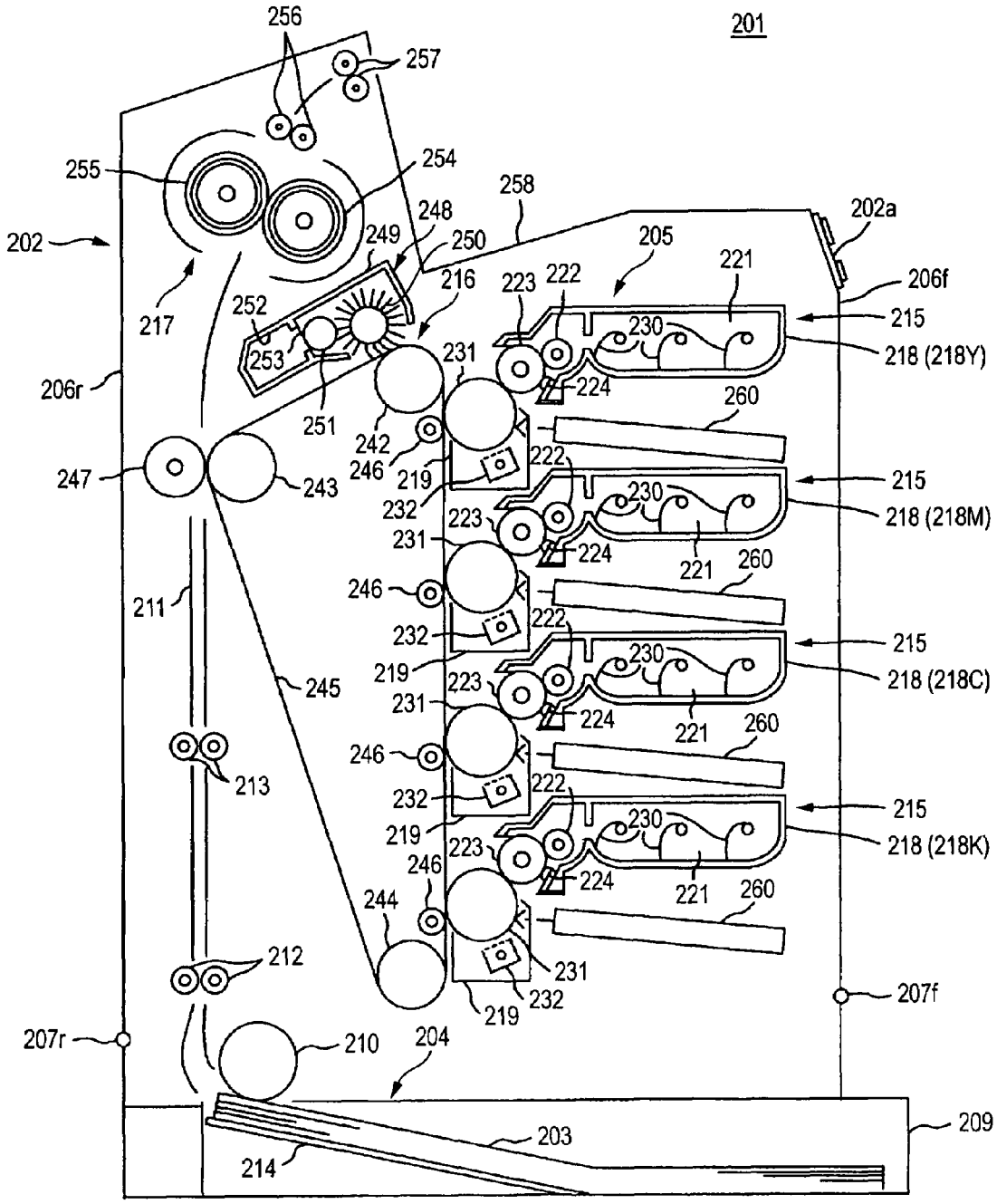
FIG. 11 is a cross sectional view showing another embodiment of a color laser printer as the apparatus for forming an image.

In the second embodiment of the invention described in the foregoing, the scanner unit 220 is provided as an exposing unit, but an LED array 260 may be provided instead of the scanner unit 220 as shown in FIG. 11. In FIG. 11, the same configurational members as those in FIG. 7 are attached with the same symbols as in FIG. 7 to omit the descriptions thereof.

The LED array 260 is disposed at the same position as the scanner unit 220 in the above embodiment, i.e., below the developing cartridge 218 in the process part 215 to overlap the photoreceptor drum 231 horizontally on the side (front side) of the photoreceptor drum 231 opposite to the transferring position. According to the configuration, the developing cartridges 218 and the LED arrays 260 do not horizontally overlap each other but alternately overlap in the vertical direction. The LED array 260 is configured by arranging a large number of LEDs and exposes by irradiating with light the surface of the photoreceptor drum 231 through light emission of the LEDs.

The color laser printer 201 according to this embodiment is equipped with the LED array 260 instead of the scanner unit 220, whereby the color laser printer 201 can be miniaturized. While the LED array 260 has a short focal length and is necessarily disposed closely to the photoreceptor drum 231, in the color laser printer 201, the drum cartridge 219 is detached in a direction opposite to the developing cartridge 218, whereby the LED array 260 can be disposed closely to the photoreceptor drum 231 without impairing replacement of the developing cartridge 218 and the drum cartridge 219.

In the color laser printer 201 according to this embodiment, the developing cartridges 218 and the drum cartridges 219 can be detached from the mainframe casing 202 in the directions substantially opposite to each other, whereby in the case where the toner is emptied out, only the developer cartridge 218 is replaced, but the expensive drum cartridge 219 can be used until the service life thereof is expired. Therefore, the running cost can be reduced. Furthermore, only the developing cartridge 218 is necessarily discarded to reduce the amount of industrial waste, whereby the color laser printer 201 good for the environment can be provided.

While the invention has been described with reference to the above embodiments, the invention can be practices with other embodiments than the aforementioned embodiments. For example, while the color laser printer 201 with an intermediate transfer system has been described as the vertical standing color laser printer 201, the invention can be applied to a color laser printer with a direct transfer system. In such a configuration, in the case where the paper 203 is jammed between the photoreceptor drum 231 and a paper conveying belt as a transfer unit, the jammed paper 203 can be easily removed from the rear opening 208*r* formed by opening the rear cover 206*r*.

While the vertical standing color laser printer 201 has been exemplified in the aforementioned embodiments, the invention can be applied to a horizontally laid color laser printer.

In the aforementioned embodiments, the developing cartridge 218 and the drum cartridge 219 are detached from the front side and the rear side, respectively, i.e., the developing cartridge 218 and the drum cartridge 219 are detached in the cross direction. It is also possible in the embodiments that the developing cartridge 218 and/or the drum cartridge 219 may be detached in the width direction. The detachment in the cross direction is preferred in the apparatus because the detachment in the width direction is practically associated with movements of bearings of the photoreceptor drum 231 and the developing roller 223.

In the aforementioned embodiments, the paper feeding path 211, the conveying rollers 212, the resist rollers 213, the intermediate transfer mechanism part 216, the fixing part 217 and the paper delivery rollers 257 are supported by the rear cover 206*r*. It is also possible that the paper feeding path 211 is released upon opening the rear cover 206*r*, and the intermediate transfer mechanism part 216 is supported by an openable member other than the rear cover 206*r*. In this case, the openable member corresponds to the first openable member.

According to an aspect of the invention, the running cost is reduced, and the amount of industrial waste can be decreased to provide an apparatus for forming an image good for the environment. Furthermore, the developing part and the image carrying member can be replaced without moving the exposing unit for exposing the image carrying member, and the developing part with a high replacement frequency can be replaced in a direction with easier access than that for the image carrying member.

According to another aspect of the invention, the developing part and the image carrying part can be easily replaced independently from each other.

According to another aspect of the invention, the image carrying part can be smoothly detached.

According to another aspect of the invention, the exposing unit can be disposed while the apparatus is downsized without inhibiting replacement of the developing part and the image carrying part.

According to another aspect of the invention, the developing part and the image carrying member can be easily replaced while formation of an electrostatic latent image on the image carrying member is ensured.

According to another aspect of the invention, the developing part with a high replacement frequency can be easily replaced without interfering with the laser scanner.

According to another aspect of the invention, the developing part can be detached with preventing interference with the laser scanner.

According to another aspect of the invention, the apparatus can be miniaturized, and the LED array can be disposed closely to the image carrying member without interfering replacement of the developing part and the image carrying part.

According to another aspect of the invention, the developing part can be smoothly detached to improve the operationality.

According to another aspect of the invention, both the simplification of the configuration of the apparatus and the miniaturization of the apparatus can be simultaneously attained.

The Third Preferred Embodiment

Figure 12:
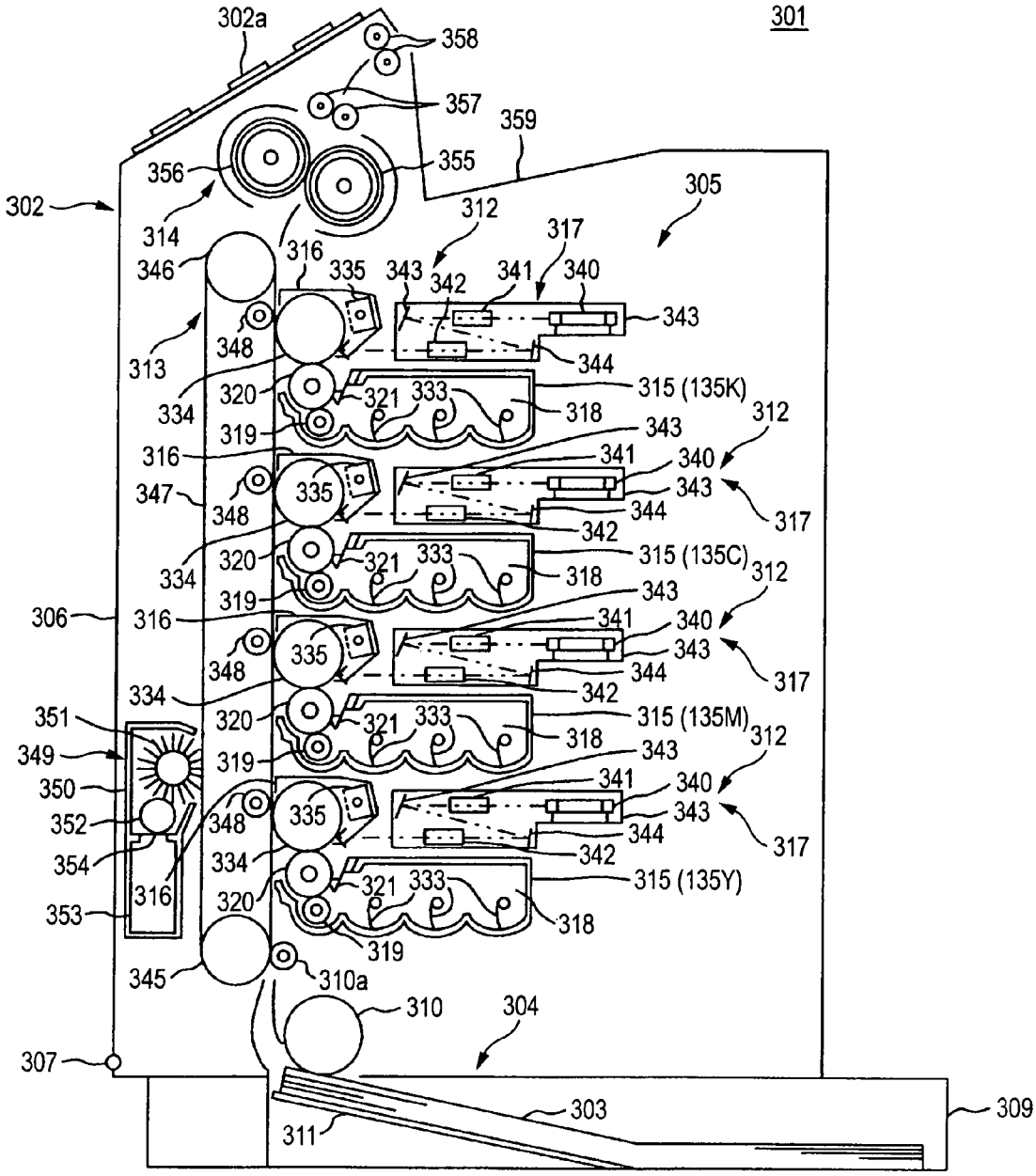
FIG. 12 is a cross sectional view showing another embodiment of a color laser printer as the apparatus for forming an image.
Figure 13:
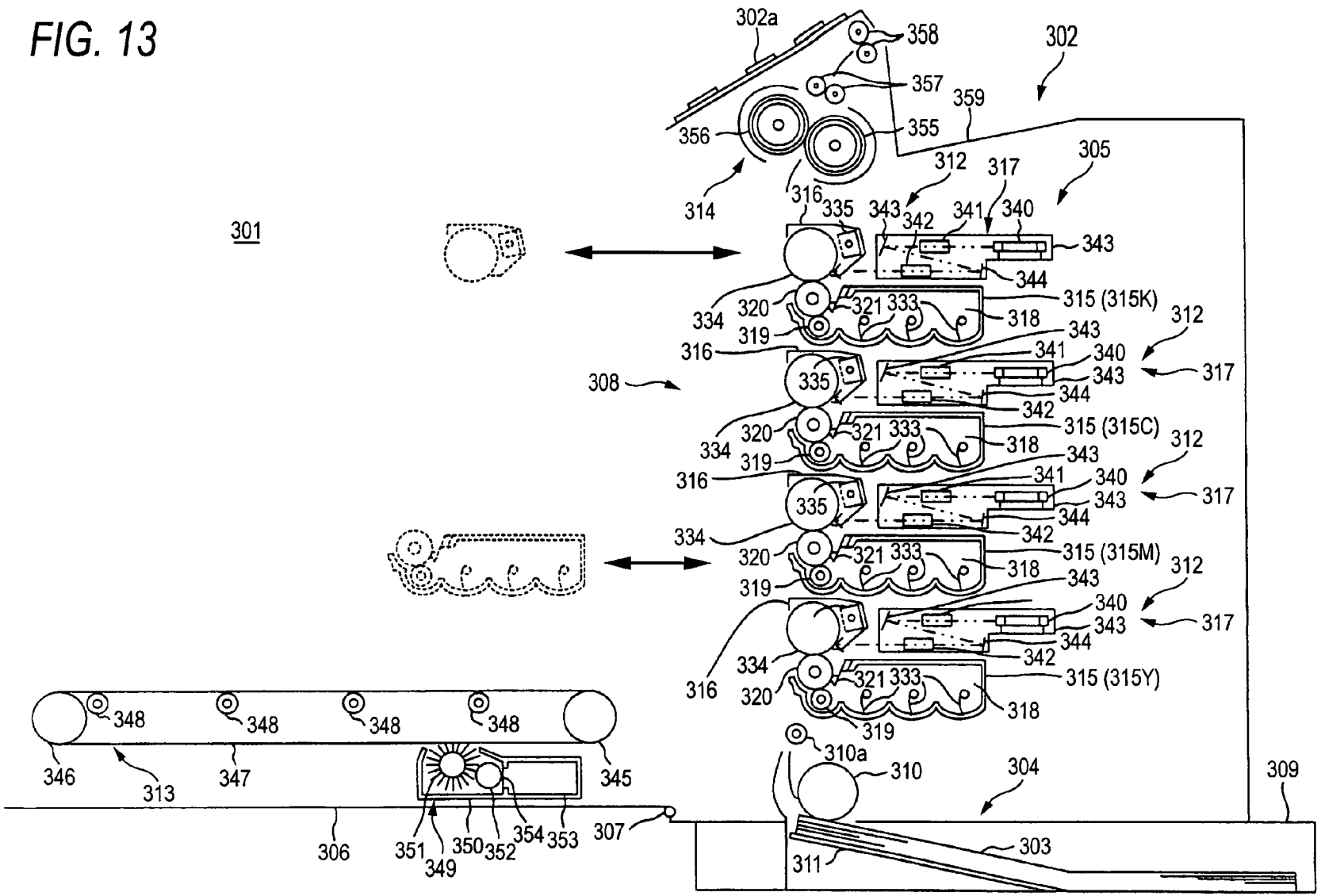
FIG. 13 is a cross sectional view showing another embodiment of the color laser printer shown in FIG. 12 in a state where an openable cover thereof is opened.
Figure 14:
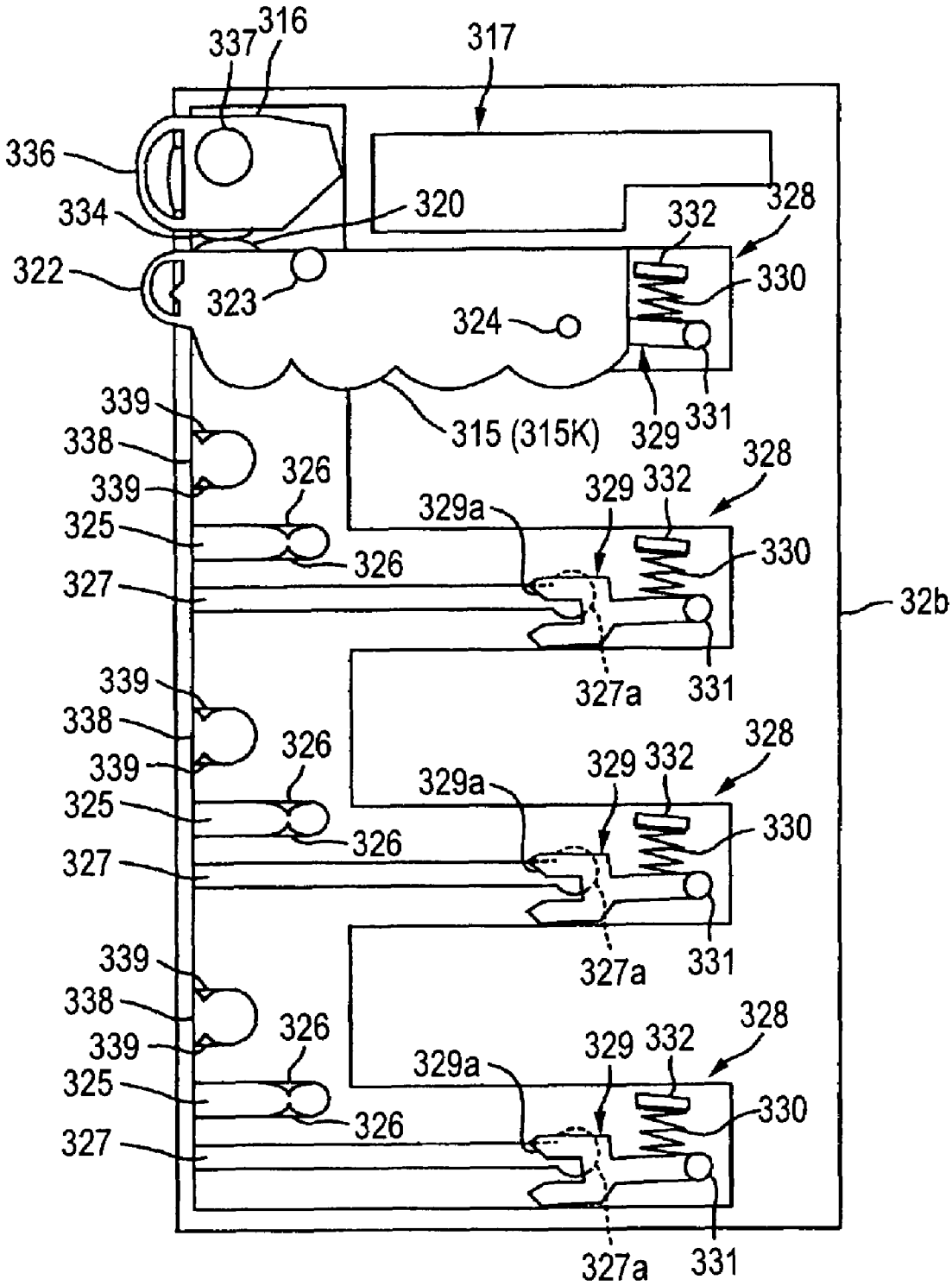
FIG. 14 is an enlarged cross sectional view showing a process part of the laser color printer shown in FIG. 12 (in a state where only a drum cartridge corresponding to a black developing cartridge is mounted).

FIG. 12 is a cross sectional view showing an embodiment of a color laser printer as an apparatus for forming an image. FIG. 13 is a cross sectional view showing an important part of the color laser printer shown in FIG. 12 in a state where an openable cover thereof is opened. FIG. 14 is an enlarged cross sectional view showing an important part of a process part of the laser color printer shown in FIG. 12 in a state where only a black developing cartridge and a yellow developing cartridge corresponding thereto are mounted.

In FIG. 12, the color laser printer 301 is a tandem type vertical standing color laser printer with a direct transfer system, which contains, inside a mainframe casing 302, a feeder part 304 for feeding paper 303 as a transfer medium, and an image forming part 305 for forming an image on the paper 303 thus fed. In the following description, the left side in FIG. 12 having an operating part 2*a* provided is referred to as a front side of the color laser printer 301, and the right side is referred to as a rear side of the color laser printer 301.

The mainframe casing 302 has, on the front side thereof, a substantially rectangular box shape and has an openable cover 306, and has, on an upper surface on the front side, an operating panel 302*a* having a liquid crystal panel displaying operation state and the like of the color laser printer 301 and user operable buttons for setting configurations. A paper delivery tray 359 described later is provided on an upper part of the mainframe casing 302.

The openable cover 306 has a plate shape, and one lower end thereof is connected to the mainframe casing 302 through a hinge 307. According to the configuration, the openable cover 306 is openably and closably swung with respect to the mainframe casing 302 with the hinge 307 as a supporting point. In the case where the openable cover 306 is opened as shown in FIG. 13, the front side of the mainframe casing 302 is left open to form an opening 308, whereby treatment of jammed paper and replacement of consumable parts can be carried out through the opening 308. In the case where the openable cover 306 is closed as shown in FIG. 12, the color laser printer 301 is set up as a printable state.

The feeder part 304 is provided at a bottom of the mainframe casing 302, and contains a paper feeding tray 309 provided detachably, a paper feeding roller 310 disposed at an upper part of one end of the paper feeding tray 309, and a conveying roller 10*a* provided above the paper feeding roller 310 to face a transfer driving roller 345 described later with a conveying belt 347 intervening therebetween. The paper feeding tray 309 is equipped with a paper pressing plate 311, one end of which facing the paper feeding roller 310 is vertically swingable. On the paper pressing plate 311, the paper 303 is stacked. The paper pressing plate 311 is biased from the back surface thereof with a spring, which is not shown in the figure, and the uppermost paper 303 stacked on the paper pressing plate 311 is pressed with the spring onto the paper feeding roller 310 and is fed one by one through rotation of the paper feeding roller 310. The paper 303 thus fed by the paper feeding roller 310 is conveyed by the conveying roller 10*a* to the transferring position, at which the photoreceptor drum 334 and the conveying belt 347 are in contact with each other.

The image forming part 305 contains a process part 312, a transfer part 313 as a transfer unit, and a fixing part 314.

The process part 312 contains a developing cartridge 315 as a developing part, a drum cartridge 316 as an image carrying part, and a scanner unit 317 as an exposing unit, and plural (four) process parts for each of colors are provided. The process parts are disposed in parallel to each other and are aligned with prescribed intervals in a substantially vertical direction.

The developing cartridges 315 contain four developing cartridge, a yellow developing cartridge 15Y, a magenta developing cartridge 15M, a cyan developing cartridge 15C and a black developing cartridge 15K, and the developing cartridges 315, which will be described in detail later, are independently detachable to the mainframe casing 302 through the opening 308 formed in the state where the openable cover 306 is opened.

The developing cartridges 315 each contains a toner housing part 318 as a developer housing chamber, a feeding roller 319, a developing roller 320 as a developer carrying member, and a squeezing plate 321.

As shown in FIG. 14, the developing cartridge 315 has a grab handle 322 as the grabbing member at the front end thereof, and a developing-side guide projection 323 and a pressure contact projection 324 are provided at both side ends in the width direction (a direction perpendicular to the cross direction on the plane view, hereinafter the same) of the developing cartridge 315. The developing cartridge 315 has an opening on the front side of the top thereof to expose a part of the developing roller 320, as shown in FIG. 12.

The grab handle 322 has a substantially arc shape on the side view and protrudes toward the front on the front end of the developing cartridge 315. Two grab handles 322 are provided as opposed to each other on both sides in the width direction of the developing cartridge 315, i.e., both sides in the axial direction of the developing roller 320.

The developing-side guide projection 323 is formed to have a substantially cylindrical shape and protrudes from the front side along the top surface of each of the both side surfaces in the width direction of the developing cartridge 315 in the directions extending outward in the width direction.

The pressure contact projection 324 is formed to have a substantially cylindrical shape and protrudes from the rear side at a substantially center part in the vertical direction (a direction perpendicular to the cross direction on the side view, hereinafter the same) of the developing cartridge 315 in the directions extending outward in the width direction.

The developing-side guide projections 323 are engaged with first guide channels 325 as a guide part formed on side plates 2*b* provided on both inside side surfaces in the width direction of the mainframe casing 302.

The first guide channels 325 are provided in parallel to each other on the mainframe casing 302 with a prescribed interval in the substantially vertical direction, and extend in the cross direction on the mainframe casing 302 at the mounting position of the developing cartridge 315, i.e., in the detaching direction of the developing cartridge 315. More specifically, the first guide channel 325 is a channel extending in the substantially horizontal direction, in which the front end thereof is opened toward the opening 308 in the state where the openable cover 306 is opened, and in the case where the developing-side guide projection 323 is positioned at the rear end (the deepest part) of the first guide channel 325, the developing roller 320 faces and in contact with the photoreceptor drum 334 through rotation of the developing cartridge 315 with the developing-side guide projection 323 as the center.

The rear end of the first guide channel 325 is provided with positioning projections 326.

The positioning projection 326 has a substantially triangular shape, and two thereof are provided to face each other in the vertical direction of the first guide channel 325. The positioning projections 326 are elastically biased in the direction, in which they approach each other, with springs, which are not shown in the figure, and position the developing-side projection 323 to rotate the developing cartridge 315 with the developing-side guide projection 323 as the center.

The pressure contact projections 324 are engaged with second guide channels 327 as a guide part formed on side plates 2*b* provided on both sides in the width direction of the mainframe casing 302.

The second guide channels 327 are provided in parallel to each other in the mainframe casing 302 with a prescribed interval in the substantially vertical direction, and extend in the cross direction on the mainframe casing 302 at the mounting position of the developing cartridge 315, i.e., in the detaching direction of the developing cartridge 315. More specifically, the second guide channel 327 is a channel extending in the substantially horizontal direction, in which the front end thereof is opened toward the opening 308 in the state where the openable cover 306 is opened, and in the case where the pressure contact projection 324 is positioned at the rear end (the deepest part) of the second guide channel 327, the developing roller 320 faces the photoreceptor drum 334.

The rear end of the second guide channel 327 is provided with a floating channel 27*a* that is formed to have a substantially circular shape on the side view having a larger diameter than the pressure contact projection 324, in which the pressure contact projection 324 is floatable.

The rear end of the second guide channel 327 is provided with a biasing member 328 as a biasing unit. The biasing member 328 contains a swinging arm 329 and a spring 330.

The swinging arm 329 has a front part having a substantially horseshoe shape on the side view capable of receiving the pressure contact projection 324 by holding in the vertical direction, and a rear part swingably supported by a swinging axis 331 provided on the mainframe casing 302.

According to the configuration, the swinging arm 329 swings with the rear part thereof supported by the swinging axis 331 as supporting point, whereby the front part thereof swings in the vertical direction at the position facing the floating channel 27*a*.

The spring 330 has one end in contact with the swinging arm 329 at the midstream of the longitudinal direction thereof, and the other end, above the one end, fixed to a fixing plate 332 provided on the mainframe casing 302.

According to the configuration, the swinging arm 329 is constantly biased downward with the spring 330 and is in contact with a pin, which is not shown in the figure, so as to be retained at a position where an upper member 29*a* of the substantially horseshoe shape member of the front part thereof faces the second guide channel 327.

The upper member 29*a* of the front part of the swinging arm 329 has a slanted front end surface capable of guiding the pressure contact projection 324 into the substantially horseshoe shape member of the front part, as described later.

In a state where the developing cartridge 315 is mounted in the mainframe casing 302, the developing-side guide projection 323 of the developing cartridge 315 is restrained from moving to the front at the rear end of the first guide channel 325 with the positioning projection 326, and the pressure contact projection 324 is held by the substantially horseshoe shape member of the front part of the swinging arm 329 in the floating channel 27*a* and pressed downward by the biasing force of the spring 330. According to the configuration, the rear side of the developing cartridge 315 is biased downward, whereby the front side thereof is biased upward with the developing-side guide projection 323 as a supporting point. Consequently, the developing roller 320 of the developing cartridge 315 is made in contact under pressure with the photoreceptor drum 334 of the drum cartridge 316 described later.

The toner housing part 318 is formed as an interior space of the developing cartridge 315, in which plural agitators 333 (for example, three agitators in this embodiment) are provided in the cross direction of the toner housing part 318 as shown in FIG. 12. The toner housing parts 318 of the respective developing cartridges 315 are charged with a positively charged non-magnetic one-component toner of yellow color for the yellow developing cartridge 15Y, that of magenta color for the magenta developing cartridge 15M, that of cyan color for the cyan developing cartridge 15C, and that of black color for the black developing cartridge 15K, respectively. The toner used herein may be a substantially spherical polymerized toner obtained by polymerizing a polymerizable monomer, such as a styrene monomer, e.g., styrene, and an acrylic monomer, e.g., acrylic acid, an alkyl (having from 1 to 4 carbon atoms) acrylate ester and an alkyl (having from 1 to 4 carbon atoms) methacrylate ester, by a known polymerization method, such as suspension polymerization. The toner contains a coloring agent corresponding to the respective colors and wax and is improved in flowability by adding an external additive, such as silica. The toner generally has a particle diameter of about from 6 to 10 μm.

The toner contained in the toner housing part 318 is discharged toward the feeding roller 319 through a toner feeding outlet opening on the side surface of the toner housing part 318 by rotation and agitation of the agitators 333 provided in the toner housing part 318.

The feeding roller 319 is rotatablly disposed on the side of the toner feeding outlet, and the developing roller 320 is rotatablly disposed on the side of the feeding roller 319 to face the feeding roller 319. The feeding roller 319 and the developing roller 320 are rotatablly supported on the developing cartridge 315 in a state where they are in contact with each other under compression to certain extent.

The feeding roller 319 is configured by covering a metallic roller axis with a roller formed with an electroconductive sponge member.

The developing roller 320 is configured by covering a metallic roller axis with a roller formed with an electroconductive rubber material as an elastic member. More specifically, the roller of the developing roller 320 has a two-layer structure containing an elastic roller formed with urethane rubber, silicone rubber, EPDM rubber or the like having electroconductivity with carbon fine particles or the like, having coated on the surface thereof a coating layer mainly containing urethane rubber, a urethane resin, a polyimide resin or the like. The developing roller 320 is disposed in such a manner that an upper part thereof is exposed upward from an opening of the developing cartridge 315 (as shown in FIG. 14), and upon developing, the developing roller 320 is applied with a developing bias voltage from an electric power source, which is not shown in the figure.

The squeezing blade 321 has a blade mainframe formed with a metallic leaf spring material and a pressing part having a hemicyclic cross section formed with insulating silicone rubber. One end of the blade mainframe is supported by the developing cartridge 315 in the vicinity of the developing roller 320, and the pressing part is in contact with the developing roller 320 under pressure by the elastic force of the blade mainframe.

The toner discharged from the toner feeding outlet is fed to the developing roller 320 through rotation of the feeding roller 319, and is charged positively through friction between the feeding roller 319 and the developing roller 320. The toner thus fed to the developing roller 320 intervenes between the pressing part of the squeezing blade 321 and the developing roller 320 associated with rotation of the developing roller 320 and is consequently carried as a thin layer having a constant thickness on the developing roller 320.

The drum cartridges 316 are disposed above the developing cartridges 315 in the respective process parts 312 for each colors, and are independently detachable to the mainframe casing 302 through the opening 308, which is formed upon opening the openable cover 306, while the configurations will be described in detail later. The drum cartridges 316 each contains a photoreceptor drum 334 as an image carrying member and a scorotron charging device 335. The drum cartridge 316 is provided with a grabbing member 336 at a front end thereof as shown in FIG. 14, and is provided with drum-side guide projections 337 as an engaging part on both sides in the width direction. The drum cartridge 316 has an opening on the front side of the lower part thereof to expose a part of the photoreceptor drum 334, as shown in FIG. 12.

The grabbing member 336 has a substantially arc shape on the side view and protrudes toward the front on the front end of the drum cartridge 316. Two grabbing members 336 are provided as opposed to each other on both sides in the width direction of the drum cartridge 316, i.e., both sides in the axial direction of the photoreceptor drum 334.

The drum-side guide projection 337 has a substantially cylindrical shape and protrudes from both side surfaces of the drum cartridge 316 at the substantially center part of the drum cartridge 316 in the direction extending outward in the width direction.

The drum-side guide projections 337 are engaged with third guide channels 338 formed on side plates 2*b* provided on both sides in the width direction inside the mainframe casing 302.

The third guide channels 338 are provided in parallel to each other on the mainframe casing 302 with a prescribed interval in the substantially vertical direction, and extend in the cross direction on the mainframe casing 302 at the mounting position of the drum cartridge 316, i.e., in the detaching direction of the drum cartridge 16. More specifically, the third guide channel 338 is a channel extending in the substantially horizontal direction, in which the front end thereof is opened toward the opening 308 in the state where the openable cover 306 is opened, and in the case where the drum-side guide projection 337 is positioned at the rear end (the deepest part) of the third guide channel 338, the developing roller 320 faces and in contact with the photoreceptor drum 334.

The front end of the third guide channel 338 is provided with a positioning projection 339.

The positioning projection 339 has a substantially triangular shape, and two thereof are provided to face each other in the vertical direction of the third guide channel 338. The positioning projections 339 are elastically biased in the direction, in which they approach each other, with springs, which are not shown in the figure.

In a state where the drum cartridge 316 is mounted in the mainframe casing 302, the drum-side guide projection 337 of the drum cartridge 316 is engaged with the third guide channel 338 at the front end thereof as being restrained from moving to the front with the positioning projection 339.

The photoreceptor drum 334 is rotatablly disposed on the drum cartridge 316 in a state where it is in contact with the developing roller 320 above the developing roller 320. According to the configuration, the developing rollers 320 and the photoreceptor drums 334 are alternately arranged, for each of colors, in the substantially vertical direction in the mainframe casing 302, i.e., in the direction perpendicular to the detaching direction of the developing rollers 320 and the photoreceptor drums 334, and more specifically, they are alternately arranged in parallel to the conveying direction of the paper 303 conveyed by the conveying belt 347 described later.

Figure 15:
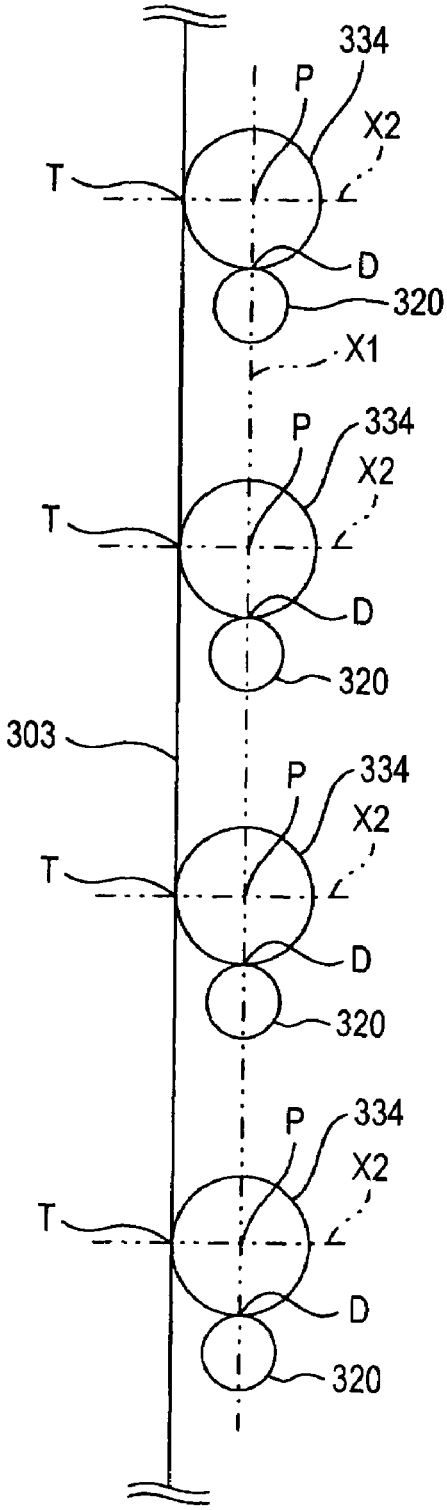
FIG. 15 is a schematic side view showing a positional relationship of photoreceptor drums, developing rollers and transfer rollers.

In the aforementioned arrangement, for each of colors, as shown in FIG. 15, the photoreceptor drum 334 and the developing roller 320 are disposed in such a manner that the line X1 connecting the rotation center P of the photoreceptor drum 334 and the developing position D of the photoreceptor drum 334 facing the developing roller 320 is substantially perpendicular to the line X2 connecting the rotation center P of the photoreceptor drum 334 and the transferring position T of the photoreceptor drum 334 facing the paper 303 conveyed by the conveying belt 347.

In the aforementioned arrangement, the developing cartridge 315 and the drum cartridge 316 are disposed as not overlapping each other in the detaching direction except for the contact part of the developing roller 320 and the photoreceptor drum 334 (i.e., a part where the surface of the developing roller 320 dented along the surface of the photoreceptor drum 334 by contacting the photoreceptor drum 334 with the developing roller 320 under pressure).

In this embodiment, there is such a possibility that the developing roller 320 and the photoreceptor drum 334 overlap each other at the contact part thereof since the developing roller 320 and the photoreceptor drum 334 are in contact with each other. In the case of a jumping developing system with the developing roller 320 and the photoreceptor drum are not in contact with each other, however, there is no part where the developing roller 320 and the photoreceptor drum 334 overlap each other.

The photoreceptor drum 334 is configured with a grounded drum mainframe having on the surface thereof a photosensitive layer formed with an organic photoreceptor mainly containing polycarbonate, and is rotatablly supported by the drum cartridge 316.

The scorotron charging device 335 is disposed on the side of the photoreceptor drum 334 opposite to the conveying belt 347 described later with a prescribed interval to the photoreceptor drum 334, so as not to be in contact therewith, as shown in FIG. 12. The scorotron charging device 334 is a scorotron type charging device generating corona discharge from a charging wire, such as tungsten, and is fixed to the drum cartridge 316 for uniformly charging the surface of the photoreceptor drum 334 positively.

The scanner unit 317 is disposed, for each of colors, in the process part 312 above the developing cartridge 315 on the side (rear side) of the photoreceptor drum 334 opposite to the transferring position, and is fixed to the mainframe casing 302. The scanner unit 317 is formed as a casing and contains a laser light emitting part, which is not shown in the figure, a polygonal mirror 340 rotationally driven, lenses 341 and 342, and a reflecting mirrors 343 and 344.

The scanner unit 317 transmits or reflects a laser beam based on image data emitted from a laser light emitting part by the polygonal mirror 340, the lens 341, the reflecting mirrors 343 and 344, and the lens 342, in this order, whereby the surface of the photoreceptor drum 334 is irradiated therewith by rapid scanning.

The toners of the respective colors are subjected to exposure and development in the following manner in the process parts 312. The surface of the photoreceptor drum 334 is uniformly charged positively with the scorotron charging device 335 associated with rotation of the photoreceptor drum 334, and then exposed by light emitted from the scanner unit 317 to form an electrostatic latent image based on the image data. Subsequently, the toner thus positively charged and carried on the developing roller 320 is electrically moved, upon contacting with the photoreceptor drum 334 associated with rotation of the developing roller 320, onto the electrostatic latent image formed on the surface of the photoreceptor drum 334, i.e., such a region on the surface of the photoreceptor drum 334 that has a lower electric potential due to exposure with the scanner unit 317, and selectively carried thereon, whereby a toner image is formed on the surface of the photoreceptor drum 334. As a result, reversal development is completed.

The transfer part 313 is disposed in the mainframe casing 302 in the substantially vertical direction to face the side (front side) of the photoreceptor drums 334 arranged in the substantially vertical direction opposite to the scanner units 317. The transfer part 313 contains a transfer driving roller 345, a transfer driven roller 346, a conveying belt 347 formed with an endless belt, a transfer roller 348, and a belt cleaner 349.

The transfer driving roller 345 is disposed below the photoreceptor drum 334 of the yellow developing cartridge 15Y and above the oblique front of the paper feeding roller 310. The transfer driven roller 346 is disposed above the photoreceptor drum 334 of the black developing cartridge 15K and below the oblique front of the fixing part 314.

The conveying belt 347 is formed with an electroconductive resin, such as polycarbonate and polyimide, having electroconductive particles, such as carbon, dispersed therein, and is wound on the transfer driving roller 345 and the transfer driven roller 346. The conveying belt 347 is disposed in such a manner that the contact surface as a back of the wound surface is in contact with all the photoreceptor drums 334 of the drum cartridges 316.

The transfer driven roller 346 is driven by driving the transfer driving roller 345, whereby the conveying belt 347 is circularly moved between the transfer driving roller 345 and the transfer driven roller 346 in the same direction as the photoreceptor drums 334 of the drum cartridges 316 on the contact surface where the conveying belt 347 faces and is in contact with the photoreceptor drums 334.

The transfer rollers 348 are disposed inside the conveying belt 347 thus wound to face the photoreceptor drums 334 of the drum cartridges 316 with the conveying belt 347 intervening therebetween. The transfer roller 348 is configured by covering a metallic roller axis with a roller formed with an elastic member, such as an electroconductive rubber material. The transfer roller 348 is rotatablly disposed to rotate in the same direction as the rotational moving direction of the conveying belt 347 on the contact surface facing and in contact with the conveying belt 347, and is applied with a transfer bias voltage upon transferring from an electric power source, which is not shown in the figure.

The belt cleaner 349 is disposed on the side (front side) of the conveying belt 347 opposite to the photoreceptor drums 334, and has, in a cleaner casing 350 disposed on the way from the transfer driving roller 345 to the transfer driven roller 346, a cleaner brush 351, a recovering roller 352, a recovering box 353 and a scraper 354.

The cleaner brush 350 has a cylindrical mainframe having brush formed radially, and is rotationally disposed in such a state that the brush faces and is in contact with the contact surface on the front side of the conveying belt 347. The cylindrical mainframe of the cleaner brush 351 is applied with a cleaning bias voltage to form an electric potential difference with respect to the conveying belt 347 from an electric power source, which is not shown in the figure, upon cleaning.

The recovering roller 352 is formed with a metallic roller and is rotatablly disposed below the cleaner brush 351 to face and be in contact with the cleaner brush 351. The recovering roller 352 is applied with a recovering bias voltage to form an electric potential difference with respect to the cleaner brush 351 from an electric power source, which is not shown in the figure, upon cleaning.

The recovering box 353 is disposed below the recovering roller 352 and has an opening on a part facing the recovering roller 352. The scraper 354 is provided in the vicinity of the opening and is in contact with the recovering roller 352 under pressure.

The transfer part 313 is supported integrally with the openable cover 306 of the mainframe casing 302. According to the configuration, in the case where the openable cover 306 is opened, the transfer part 313 moves integrally with the openable cover 306 thus opened, so as to be disposed substantially horizontally. In the case where the openable cover 306 is closed, the transfer part 313 is disposed substantially vertically as shown in FIG. 12, and the conveying belt 347 is made in contact with the photoreceptor drums 334 under pressure.

The paper 303 fed from the feeder part 304 is conveyed by the conveying belt 347 circularly moving through driving of the transfer driving roller 345 and driven of the transfer driven roller 346 from the lower side toward the upper side under guiding of the conveying roller 10*a*, and passes between the conveying belt 347 and the photoreceptor drums 334 of the drum cartridges 316 (i.e., the transferring positions) sequentially. The toner images of the respective colors formed on the photoreceptor drums 334 of the drum cartridges 316 are sequentially transferred to the paper 303 during the period where the paper 303 passes the transferring positions, so as to form a color image on the paper 303.

Specifically, a yellow toner image formed on the photoreceptor drum 334 of the yellow developing cartridge 15Y is transferred on the paper 303, and then a magenta toner image formed on the photoreceptor drum 334 of the magenta developing cartridge 15M is transferred to the paper 303 to overlap the yellow toner image having been transferred. A cyan toner image formed by the cyan developing cartridge 15C and a black toner image formed by the black developing cartridge 15K are then sequentially transferred in the same procedures to form a color image on the paper 303.

The toner attached to the conveying belt 347 after transferring the color image to the paper 303 is scraped with and attached to the cleaner brush 351 by the cleaning bias voltage applied to the cleaner brush 351 when the toner faces the cleaner brush 351. Thereafter, the toner attached to the cleaner brush 351 is attached to the recovering roller 352 by the recovering bias voltage applied to the recovering roller 352 when the toner faces the recovering roller 352, and then the toner is scraped with the scraper 354 and recovered into the recovering box 353.

In the color laser printer 301, the remaining toner is recovered by the so-called cleanerless developing system, in which the toner remaining on the surface of the photoreceptor drum 334 is recovered with the developing roller 320. Specifically, the photoreceptor drum 334 is again charged with the scorotron charging device 335 associated with rotation of the photoreceptor drum 334, and then exposed with the scanner unit 317. Upon contacting the developing roller 320 with the photoreceptor drum 334, the remaining toner present on a non-exposed region on the surface of the photoreceptor drum 334 is moved to and recovered by the developing roller 320 through the developing bias voltage. The toner remaining on an exposed region forms a toner image along with a toner that is newly moved from the developing roller 320 to the exposed region.

The peripheral velocity of the photoreceptor drum 334 and the peripheral velocity of the developing roller 320 are differentiated from each other to provide a peripheral velocity difference to facilitate recovery of the remaining toner from the photoreceptor drum 334 to the developing roller 320 through the electric potential difference. Specifically, the peripheral velocity of the developing roller 320 is 1.6 times the peripheral velocity of the photoreceptor drum 334. The polymerized toner causes a small amount of the remaining toner and is easily movable through an electric potential difference, and therefore, the remaining toner can be favorably recovered by the developing roller 320.

According to the formation of a color image described in the foregoing, the color laser printer 301 has a tandem type system having plural photoreceptor drums 334 for respective colors, and therefore, toner images of respective colors are formed at a speed equivalent to formation of a monochrome image, so as to attain rapid formation of a color image.

The fixing part 314 is disposed above the transfer part 313 and contains a first heating roller 355 in contact with the surface of the paper having a color image transferred thereon, a second heating roller 356 disposed to face the first heating roller 355 with the paper 303 intervening therebetween and being in contact with the back surface of the paper 303, and a pair of conveying rollers 357 disposed above the first heating roller 355 and the second heating roller 356.

The first heating roller 355 contains a cylindrical metallic tube, such as aluminum, a halogen heater for heating provided therein, and an elastic layer formed outside the tube. The second heating roller 356 contains, as similar to the first heating roller 355, a cylindrical metallic tube, such as aluminum, a halogen heater for heating provided therein, and an elastic layer formed outside the tube, and is disposed to press the first heating roller 355.

The color image thus transferred on the paper 303 is thermally fixed thereon with the first heating roller 355 and the second heating roller 356 during a period when the paper 303 passes through between the first heating roller 355 and the second heating roller 356, and then the paper 303 is conveyed with the conveying rollers 357 to paper delivery rollers 358.

The paper delivery rollers 358 are disposed above the conveying roller 357 and in the vicinity of a paper delivery outlet, and the paper 303 thus conveyed with the conveying roller 357 is delivered to the paper delivery tray 359 with the paper delivery rollers 358.

In the color laser printer 301, one of the developing cartridge 315 and the drum cartridge 316 can be independently detached on the mainframe casing 302, irrespective to the presence or absence of the other attached to the mainframe casing 302. For example, in the case where only the developing cartridge 315 is detached, the openable cover 306 is opened to dispose the transfer part 313 in the substantially horizontal direction, so as to form the opening 308, through which the developing cartridges 315 and the drum cartridges 316 are exposed on the front side of the mainframe casing 302.

In the case where the developing cartridge 315 mounted in the mainframe casing 302 is removed from the mainframe casing 302, the grabbing member 322 of the developing cartridge 315 is grasped, and the developing cartridge 315 is slightly pushed down. Thus, the rear side of the developing cartridge 315 is biased upward with the developing-side guide projection 323 as a supporting point, whereby the pressure contact projection 324, which is disposed in the floating channel 27*a* of the second guide channel 327 and held inside the substantially horseshoe shape member at the front side of the swinging arm 329, presses upward the upper member 29*a* at the front side of the swinging arm 329, so as to swing upward the front end of the swinging arm 329 against the bias force of the spring 330 with the swinging axis 331 as a supporting point. Accordingly, the pressure contact projection 324 moves upward inside the floating channel 27*a*.

Subsequently, while the grabbing member 322 of the developing cartridge 315 is still grasped, the developing cartridge 315 is withdrawn to the front side from the mainframe casing 302. Thus, the developing-side guide projection 323 disposed at the rear end of the first guide channel 325 overstrides the positioning projection 326 by pressing down the positioning projection 326 against the bias force of the positioning projection 326, and is guided to the front side along the first guide channel 325, and the pressure contact projection 324 is guided to the front side along the second guide channel 327, so as to move the developing cartridge 315 to the front side. Thereafter, the developing cartridge 315 is removed from the mainframe casing 302 and taken out through the opening 308, as shown by a virtual image shown by broken lines in FIG. 13.

In the case where the developing cartridge 315 is mounted on the mainframe casing 302, the openable cover 306 is opened, and while the developing cartridge 315 is inserted into the mainframe casing 302 through the opening 308 by grasping the grabbing member 322 of the developing cartridge 315, the pressure contact projection 324 is engaged with the second guide channel 327, and then the developing-side guide projection 323 is engaged with the first guide channel 325. Thereafter, the developing cartridge 315 is pressed onto the rear side of the mainframe casing 302, whereby the developing cartridge 315 is moved to the rear side with the developing-side guide projection 323 being guided to the rear side along the first guide channel 325, and the pressure contact projection 324 being guided to the rear side along the second guide channel 327. Subsequently, the developing-side guide projection 323 overstrides the positioning projection 326 by pressing down the positioning projection 326 against the bias force of the positioning projection 326, and is retained at the rear end of the first guide channel 325 in a state where it is restrained from moving to the front with the positioning projection 326. The pressure contact projection 324 is made in contact with the upper member 29*a* at the front side of the swinging arm 329 and guided by the substantially horseshoe shape member at the front side of the swinging arm 329, whereby the front side of the swinging arm 329 once swings upward with the swinging axis 331 as a supporting point, and when the pressure contact projection 324 is disposed in the floating channel 27*a*, the swinging arm 329 is then biased downward with the bias force of the spring 330, and thus, the front part thereof is moved downward to move the pressure contact projection 324 downward. Consequently, the rear side of the developing cartridge 315 is biased downward, and thus the front side thereof is biased upward with the developing-side guide projection 323 as a supporting point, whereby the developing roller 320 is in contact with the photoreceptor drum 334 under pressure.

In the case where the drum cartridge 316 is detached, for example, the openable cover 306 is opened, and the transfer part 313 is substantially horizontally disposed as shown in FIG. 13, so as to form the opening 308, through which the developing cartridges 315 and the drum cartridges 316 are exposed on the front side of the mainframe casing 302.

In the case where the drum cartridge 316 mounted in the mainframe casing 302 is removed from the mainframe casing 302, the grabbing member 336 of the drum cartridge 316 is grasped, and the drum cartridge 316 is withdrawn from the mainframe casing 302 to the front side. The drum-side guide projection 337 disposed at the rear end of the third guide channel 338 overstrides the positioning projection 339 by pressing down the positioning projection 339 against the bias force of the positioning projection 339, and is guided to the front side along the third guide channel 338, and the drum cartridge 316 is moved to the front side. The drum cartridge 316 is then removed from the mainframe casing 302 and taken out through the opening 308, as shown by a virtual image shown by broken lines in FIG. 13.

In the case where the drum cartridge 316 is mounted on the mainframe casing 302, the openable cover 306 is opened, and while the drum cartridge 316 is inserted into the mainframe casing 302 through the opening 308 by grasping the grabbing member 336 of the drum cartridge 316, the drum-side guide projection 337 is engaged with the third guide channel 338. Thereafter, the drum cartridge 316 is pressed onto the rear side of the mainframe casing 302, whereby the drum cartridge 316 is moved to the rear side with the drum-side guide projection 337 being guided to the rear side along the third guide channel 338. Subsequently, the drum-side guide projection 337 overstrides the positioning projection 339 by pressing down the positioning projection 339 against the bias force of the positioning projection 339, and is retained at the rear end of the third guide channel 338 in a state where it is restrained from moving to the rear with the positioning projection 339.

Upon detaching the developing cartridge 315 or the drum cartridge 316 as described in the foregoing, the developing roller 320 and the photoreceptor drum 334 having been in contact with each other are not in friction with each other, whereby they can be effectively prevented from being damaged.

In the color laser printer 301, accordingly, one of the developing cartridges 315 and the drum cartridges 316 can be independently detached from the mainframe casing 302, irrespective to the presence or absence of the other attached to the mainframe casing 302, whereby only the developing cartridge 315 can be replaced when the toner is emptied out, but the expensive drum cartridge 316 can be used until the service life thereof is expired. As a result, the running cost can be reduced. Furthermore, only the spent developing cartridge 315 may be discarded, and therefore, the amount of industrial waste can be decreased to provide an apparatus for forming an image good for the environment.

In the color laser printer 301, the developing cartridges 315 and the drum cartridges 316 can be smoothly detached through the opening 308 formed on the front side of the mainframe casing 302 upon opening the openable cover 306. Furthermore, the transfer part 313 is provided in the detaching direction of the developing cartridges 315 and the drum cartridges 316, whereby treatment of jammed paper and replacement of the developing cartridge 315 and the drum cartridge 316 can be carried out from the same side to provide improved operationality.

In the color laser printer 301, the developing rollers 320 and the photoreceptor drums 334 are disposed in such a manner that the line X1 connecting the rotation center P of the photoreceptor drum 334 and the developing position D of the photoreceptor drum 334 facing the developing roller 320 is substantially perpendicular to the line X2 connecting the rotation center P of the photoreceptor drum 334 and the transferring position T of the photoreceptor drum 334 facing the paper 303 conveyed by the conveying belt 347, whereby the developing rollers 320 and the photoreceptor drums 334 can be easily replaced independently from each other. In the color laser printer 301, furthermore, the scanner unit 317 is disposed on the side of the photoreceptor drum 334 opposite to the transferring position, whereby the scanner unit 317 can be disposed while the apparatus is miniaturized without impairing replacement of the developing roller 320 and the photoreceptor drum 334.

In the color laser printer 301, upon replacing the developing cartridge 315 and the drum cartridge 316, the developing cartridge 315 and the drum cartridge 316 can be detached from the same side (front side) of the color laser print 1, whereby the operationality can be improved.

In the color laser printer 301, furthermore, upon replacing the developing cartridge 315 and the drum cartridge 316, the developing cartridge 315 and the drum cartridge 316 is detached to the mainframe casing 1 by grasping the grab handle 322 of the developing cartridge 315 or the grab handle 336 of the drum cartridge 316, whereby the developing roller 320 or the photoreceptor drum 334 are not damaged, for example, by accidentally touching them, by grasping the grab handle 322 or 336, so as to facilitate replacement of the developing cartridge 315 and the drum cartridge 316.

Moreover, upon replacing the developing cartridge 315 and the drum cartridge 316, the developing cartridge 315 and the drum cartridge 316 are detached to the mainframe casing 302 by grasping the grab handles 322 and 336, whereby smooth replacement thereof is facilitated to ensure smooth detaching operation, and thus the operationality of the detaching operation can be improved.

In the color laser printer 301, upon mounting the developing cartridge 315 and the drum cartridge 316, the developing cartridge 315 and the drum cartridge 316 can be guided by the first guide channel 325 and the third guide channel 338, respectively, provided on the side plate 2*b* of the mainframe casing 302, and when the developing cartridge 315 and the drum cartridge 316 reach the rear ends thereof, they are positioned with the positioning projection 326 and the positioning projection 339, respectively, whereby the developing cartridge 315 and the drum cartridge 316 can be thus mounted and positioned. Consequently, a color image with less color drift can be formed while the detaching operation of the developing cartridge 315 and the drum cartridge 316 is facilitated.

In the color laser printer 3301, furthermore, the developing roller 320 of the developing cartridge 315 is biased with the biasing member 328 toward the photoreceptor drum 334 of the drum cartridge 316 having been positioned with the positioning projection 339, whereby the developing roller 320 and the photoreceptor drum 334 can be in contact with each other while they are positioned. Accordingly, a color image with high quality can be formed while formation failure of an image is prevented from occurring.

The color laser printer 301 employs the cleanerless developing system, in which the remaining toner remaining on the photoreceptor drum 334 after transferring the toner image carried on the photoreceptor drum 334 to the paper 303 is recovered by the developing roller 320, whereby a waste toner storage for recovering and storing the remaining toner is not necessary. Accordingly, the configuration of the apparatus can be simplified, and the apparatus can be miniaturized. As a result, the developing cartridge 315 and the scanner unit 316 can be disposed to overlap substantially vertically owing to the absence of the space for providing a waste toner storage, whereby the footprint of the color laser printer 301 can be reduced.

While the vertical standing direct transfer tandem type color laser printer 301 as one embodiment has been described with reference to FIGS. 1 to 4, the invention can be applied to a horizontally laid intermediate transfer color laser printer 301 as another embodiment shown in FIGS. 5 and 6. In FIGS. 5 and 6, the same configurational members as those in FIGS. 1 and 2 are attached with the same symbols as in FIGS. 1 and 2, and this embodiment has the same configuration as in the above embodiment except for those described below. In the following description, the right side in FIG. 16 having an operating panel 302*a* provided is referred to as a front side of the color laser printer 301, and the left side is referred to as a rear side of the color laser printer 301.

Figure 16:
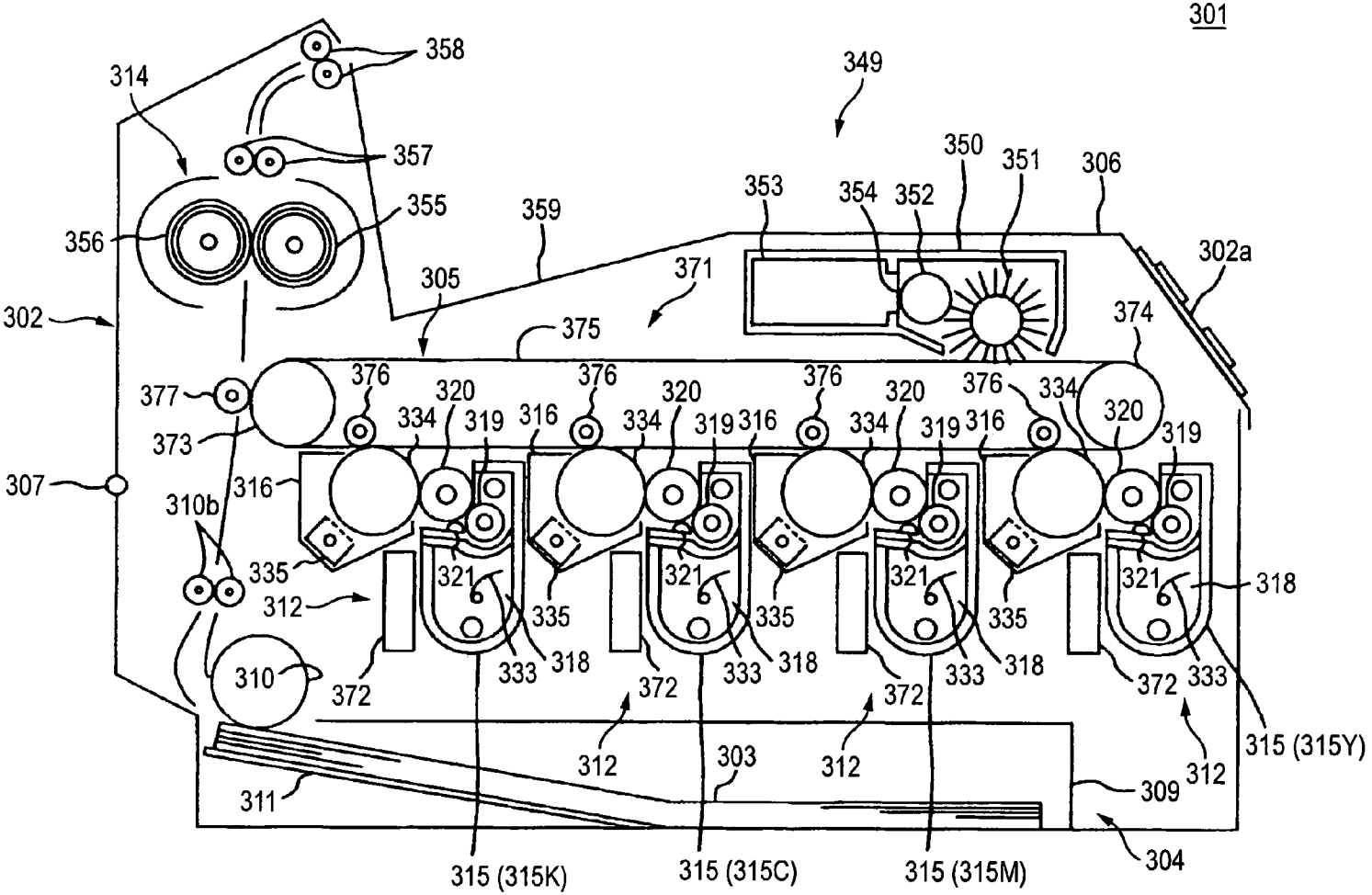
FIG. 16 is across sectional view showing another embodiment of a color laser printer as the apparatus for forming an image.

The color laser printer 301 shown in FIG. 16 has an intermediate transfer mechanism part 371 as a transfer unit disposed in the cross direction of the mainframe casing 302, and has an LED array 372 as an exposing unit instead of the scanner unit 317 used in the above embodiment.

The mainframe casing 302 has an openable cover 306 as an openable member.

Figure 17:
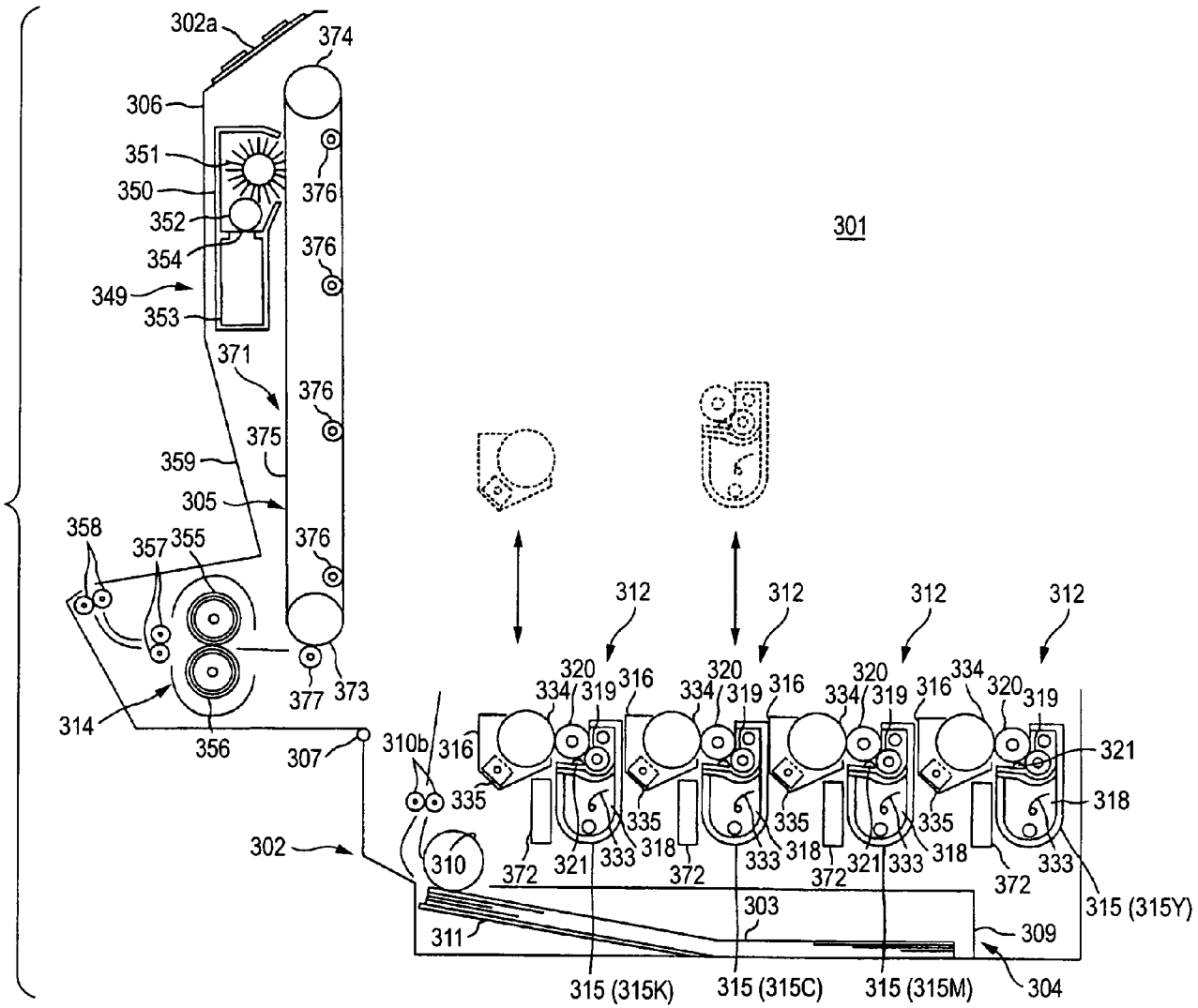
FIG. 17 is a cross sectional view showing the color laser printer shown in FIG. 16 in a state where an openable cover thereof is opened.

The openable cover 306 covers the upper surface of the mainframe casing 302, and the rear end thereof is connected to the mainframe casing 302 through hinge 307. The openable cover 306 is openably and closably swung with respect to the mainframe casing 302 with the hinge 307 as a supporting point. In the case where the openable cover 306 is opened as shown in FIG. 17, the upper side of the mainframe casing 302 is left open to form an opening 308, and in the case where the openable cover 306 is closed as shown in FIG. 16, the color laser printer 301 is set up as a printable state.

The developing cartridges 315 each contains a toner housing part 318, a feeding roller 319, a developing roller 320, a squeezing plate 321 and an agitator 333, and are arranged in parallel to each other in the cross direction of the mainframe casing 302.

The developing cartridges 315 are detachable along the first guide channels and the second guide channels as similar to the above embodiment, which are provided in parallel to each other on the side plates of the mainframe casing 302 with a prescribed interval in the substantially horizontal direction, and extend in the vertical direction on the mainframe casing 302 at the mounting positions of the developing cartridges 315, i.e., in the detaching direction of the developing cartridges 315.

The drum cartridges 316 each contains a photoreceptor drum 334 and a scorotron charging device 335 as similar to the drum cartridge 316 in the above embodiment, and arranged in the mainframe casing 302 in parallel to each other in the cross direction of the mainframe casing 302 on the back side of the developing cartridges 315 along the intermediate transfer mechanism part 371 described later. The drum cartridges 316 are detachable along the third guide channels as similar to the above embodiment, which are provided in parallel to each other on the side plates of the mainframe casing 302 with a prescribed interval in the substantially horizontal direction, and extend in the vertical direction on the mainframe casing 302 at the mounting positions of the drum cartridges 316, i.e., in the detaching direction of the drum cartridges 316.

According to the arrangement, the developing rollers 320 and the photoreceptor drums 334 are alternately arranged in parallel to the circular movement direction of an intermediate transfer belt 375 as a transfer medium described later in a region where it faces the photoreceptor drums 334.

The LED array 372 is disposed in the mainframe casing 302 on the rear side of the developing cartridge 315 on the side (lower side) of the photoreceptor drum 334 opposite to the transferring position facing the intermediate transfer belt 375 described later. The LED array 372 is configured by arranging a large number of LEDs and exposes by irradiating with light the surface of the photoreceptor drum 334 through light emission of the LEDs.

The intermediate transfer mechanism part 371 is disposed in the mainframe casing 302 along the cross direction of the mainframe casing 302 to face the photoreceptor drums 334. The intermediate transfer mechanism part 371 contains an intermediate transfer belt driving roller 373 provided on the rear side of the mainframe casing 302, an intermediate transfer belt driven roller 374 provided on the front side of the mainframe casing 302, an intermediate transfer belt 375, which is wound on the outer peripheries of the intermediate transfer belt driving roller 373 and the intermediate transfer belt driven roller 374 and extends in the substantially horizontal direction, a primary transfer roller 376, a secondary transfer roller 377, and a belt cleaner 349.

In the intermediate transfer mechanism part 371, the intermediate transfer belt driven roller 374 is driven by driving the intermediate transfer belt driving roller 373, whereby the transfer surface of the intermediate transfer belt 375 facing the photoreceptor drums 334 is circularly moved from the front side toward the rear side of the color laser printer 301.

The primary transfer rollers 376 are disposed to face the photoreceptor drums 334 with the intermediate transfer belt 375 intervening therebetween. The primary transfer roller 376 is configured by covering a metallic roller axis with a roller formed with as an electroconductive rubber material, and is applied with a transfer bias voltage from an electric power source, which is not shown in the figure.

The secondary transfer roller 377 is rotatablly disposed at a position facing the intermediate transfer belt driving roller 373 of the intermediate transfer mechanism part 371 with the intermediate transfer belt 375 intervening therebetween. The secondary transfer roller 377 is configured by covering a metallic roller axis with a roller formed with as an electroconductive rubber material, and is applied with a transfer bias voltage from an electric power source, which is not shown in the figure.

The belt cleaner 349 is disposed on the side (upper side) of the intermediate transfer belt 375 opposite to the photoreceptor drums 334 and on the way from the intermediate transfer belt driving roller 373 to the intermediate transfer belt driven roller 374, and contains a cleaner brush 351, a recovering roller 352, a recovering box 353 and a scraper 354, as similar to the above embodiment.

In the intermediate transfer mechanism part 371, the intermediate transfer belt 375 is circularly moved associated with rotation of the intermediate transfer belt driving roller 373 to the intermediate transfer belt driven roller 374 to face the photoreceptor drums 334 sequentially, whereby toner images of respective colors formed on the photoreceptor drums 334 are sequentially accumulated on the intermediate transfer belt 375 to form a color image on the intermediate transfer belt 375. The color image thus formed on the intermediate transfer belt 375 is transferred to the paper 303 at once during a period when the paper 303 passes through between the intermediate transfer belt 375 and the secondary transfer roller 377.

The fixing part 314 is disposed above the secondary transfer roller 377 and contains a first heating roller 355, a second heating roller 356 and a conveying rollers 357, as similar to the above embodiment.

In the color laser printer 301 according to this embodiment, the intermediate transfer mechanism part 371, the fixing part 314, the paper delivery rollers 358 and the operation panel 302*a* are integrally supported by the openable cover 306. According to the configuration, in the case where the openable cover 306 is opened, the intermediate transfer mechanism part 371, the fixing part 314, the paper delivery rollers 358 and the operation panel 302*a* are integrally moved along with the openable cover 306 thus opened, whereby the intermediate transfer belt 375 of the intermediate transfer mechanism part 371 is disposed in the substantially vertical direction, as shown in FIG. 17, and in the case where the openable cover 306 is closed, the intermediate transfer belt 375 of the intermediate transfer mechanism part 371 is disposed in the substantially horizontal direction, and the intermediate transfer belt 375 is made in contact with the photoreceptor drums 334 under pressure, as shown in FIG. 16.

In the color laser printer 301 according to this embodiment, the openable cover 306 is opened to dispose the intermediate transfer mechanism part 371 in the substantially vertical direction, whereby one of the developing cartridge 315 and the drum cartridge 316 can be independently detached as shown by a virtual image shown by broken lines, irrespective to the presence or absence of the other attached to the mainframe casing 302, as shown in FIG. 17.

According to the configuration, as similar to the above embodiment, only the developing cartridge 315 can be replaced when the developer is emptied out, but the expensive drum cartridge 316 can be used until the service life thereof is expired. As a result, the running cost can be reduced. Furthermore, only the spent developing cartridge 315 may be discarded, and therefore, the amount of industrial waste can be decreased to provide a color laser printer 301 good for the environment.

The color laser printer 301 according to this embodiment is equipped with the LED array 372 instead of the scanner unit 317, whereby the color laser printer 301 can be miniaturized. While the LED array 372 has a short focal length and is necessarily disposed closely to the photoreceptor drum 334, in the color laser printer 301, the LED array 372 is disposed on the side of the photoreceptor drum 334 opposite to the transferring position facing the intermediate transfer belt 375, whereby the LED array 372 can be disposed closely to the photoreceptor drum 334 without impairing replacement of the developing cartridge 315 and the photoreceptor drum 334.

While the invention has been described with reference to the two embodiments, the invention can be practices with other embodiments than the aforementioned embodiments. For example, while the color laser printer with a direct transfer system has been described as the vertical standing color laser printer 301, the invention can be applied to a vertical standing color laser printer with an intermediate transfer system. Furthermore, while the scanner unit 317 is exemplified as an exposing unit in the above embodiment, an LED array 372 may be used in the above embodiment.

While the color laser printer with an intermediate transfer system has been described as the horizontally laid color laser printer 301 in this embodiment, the invention may be applied to a horizontal laid color laser printer with a direct transfer system. Furthermore, while the LED array 372 is exemplified as an exposing unit in this embodiment, a scanner unit 371 may be used in this embodiment.

While the scanner unit 317 is fixed with the developing cartridge 315 and the drum cartridge 316 being detached in the above embodiments, it is possible, for example, that the scanner unit 317 is movably provided, and after evacuating the scanner unit 317, the developing cartridge 315 and the drum cartridge 316 are detached.

While the developing cartridge 315 and the drum cartridge 316 are detached from the front side or the upper side of the color laser printer 301 in the above embodiments, the developing cartridge 315 and/or the drum cartridge 316 may be detached in the width direction in the invention. The detachment in the cross direction or the vertical direction of the color laser printer 301 is preferred as the configuration of the apparatus because the detachment in the width direction is practically associated with movements of bearings of the developing roller 320 and the photoreceptor drum 331.

According to one aspect of the invention, the running cost is reduced, and the amount of industrial waste can be decreased to provide an apparatus for forming an image good for the environment.

According to another aspect of the invention, the operationality is improved.

According to another aspect of the invention, the replacement of the developing part and the image carrying part can be easily attained independently from each other.

According to another aspect of the invention, the developing part and the image carrying part can be smoothly detached, and treatment of jammed paper and replacement of the developing part and the image carrying part can be can be carried out from the same direction, so as to improve the operationality.

According to another aspect of the invention, the exposing unit can be disposed while the apparatus is miniaturized without impairing replacement of the developing part and the image carrying part.

According to another aspect of the invention, the apparatus can be miniaturized, and the LED array can be disposed closely to the image carrying member without interfering replacement of the developing part and the image carrying part.

According to another aspect of the invention, the developer carrying member and the image carrying member can be easily replaced independently from each other.

According to another aspect of the invention, the developer carrying member and the image carrying member can be easily replaced independently from each other.

According to another aspect of the invention, the operationality of the detaching operation can be improved.

According to another aspect of the invention, replacement of the developing part and the image carrying part can be smoothly carried out to ensure smooth detaching operation.

According to another aspect of the invention, a color image with less color drift can be formed while the detaching operation of the developing part and the image carrying part is facilitated.

According to another aspect of the invention, a color image with high quality can be formed while formation failure of an image is prevented from occurring.

According to another aspect of the invention, the configuration of the apparatus can be simplified, and the apparatus can be miniaturized.

While the invention has been described in conjunction with the specific embodiments described above, many equivalent alternatives, modifications and variations may be come apparent to those skilled in the art when given this disclosure. Accordingly, the exemplary embodiments of the invention as set forth above are considered to be illustrative and not limiting. Various changes to the described embodiments maybe made without departing from the spirit and scope of the invention.

What is claimed is:

1. An image forming apparatus comprising:

a main frame casing formed with an opening;

a door provided with the main frame casing, the door being configured to cover the opening;

a plurality of drum cartridges provided in the main frame casing in a substantially horizontal arrangement, each of the plurality of drum cartridges being removable from the main frame casing and comprising a photosensitive drum;

an optical unit provided in the main frame casing, the optical unit being configured to irradiate a light to a surface of each of the photosensitive drums;

a plurality of developer cartridges provided in the main frame casing, each of the plurality of developer cartridges being removable from the main frame casing and comprising a toner housing part configured to accommodate a toner therein; and a belt unit that comprises a belt, the belt unit being configured to be positioned at a first position and a second position;

wherein the plurality of photosensitive drums are covered by the belt unit when the belt unit is in the first position.

2. The image forming apparatus of claim 1, wherein the plurality of developer cartridges are installable to and removable from the main frame casing through the opening when the belt unit is in the second position.

3. The image forming apparatus of claim 1, wherein the plurality of photosensitive drums are installable to and removable from the main frame casing through the opening when the belt unit is in the second position.

4. The image forming apparatus of claim 1, wherein each of the plurality of developer cartridges further comprises:

a developer roller configured to oppose one of the plurality of photosensitive drums when the developer roller and the opposing one of the plurality of photosensitive drums are installed in the main frame casing.

5. The image forming apparatus of claim 1, further comprising:

a fixing part provided in the main frame casing, the fixing part being configured to heat a recording medium;

wherein the fixing part is configured to move between a third position and a fourth position; and wherein the fixing part is in the third position when the belt unit is in the first position, and the fixing part is in the fourth position when the belt unit is in the second position.

6. The image forming apparatus of claim 1, wherein the belt unit is disposed in the door.

7. The image forming apparatus of claim 1, wherein fixing part is disposed in the door.

8. The image forming apparatus of claim 1, wherein the plurality of drum cartridges are removable from the main frame casing in a direction away from the optical unit.

9. The image forming apparatus of claim 1, wherein the optical unit further comprises a plurality of optical units, each of the plurality of optical units corresponding to one of the plurality of drum cartridges, wherein each optical unit and each drum cartridge are alternately arranged.

10. The image forming apparatus of claim 9, wherein each of the plurality of optical units is an LED array.

11. The image forming apparatus of claim 1, further comprising:

a paper feeding tray provided below the optical unit, the paper feeding tray being configured to accommodate a recording medium on which an image is to be formed; and a paper delivery tray provided with the door, the paper delivery tray being configured to accommodate the recording medium on which the image is formed;

wherein the plurality of drum cartridges are positioned between the belt unit and the optical unit when the door is closed.

12. The image forming apparatus of claim 1, wherein the belt unit is configured to receive the toner from the plurality of photosensitive drums and transfer the toner to a recording medium.

* * * * *